US006173140B1

(12) United States Patent
Suzuki et al.

(10) Patent No.: US 6,173,140 B1
(45) **Date of Patent: *Jan. 9, 2001**

(54) COUPLING MEMBER, PROCESS CARTRIDGE AND ASSEMBLING METHOD OF PROCESS CARTRIDGE

(75) Inventors: Akira Suzuki, Odawara; Hiroomi Matsuzaki, Mishima; Shigeo Miyabe, Numazu; Kazuo Chadani, Shizuoka-ken, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/041,695

(22) Filed: Mar. 13, 1998

(30) Foreign Application Priority Data

Mar. 18, 1997 (JP) ..... 9-084457
Mar. 5, 1998 (JP) ..... 10-053379

(51) Int. Cl.[7] ..... G03G 21/18
(52) U.S. Cl. ..... 399/113; 399/110
(58) Field of Search ..... 399/107, 110, 399/111, 113, 116, 119

(56) References Cited

U.S. PATENT DOCUMENTS 5,153,640 * 10/1992 Okabe ..... 399/113
5,450,166 9/1995 Yashiro ..... 355/210
5,502,547 * 3/1996 Shirai ..... 399/111 X
5,528,343 * 6/1996 Tada et al. ..... 399/113
5,537,187 * 7/1996 Sekine ..... 399/113
5,745,824 * 4/1998 Yashiro ..... 399/113
5,749,027 * 5/1998 Ikemoto et al. ..... 399/113

FOREIGN PATENT DOCUMENTS 0 586 044 A2 3/1994 (EP) .
0 631 207 A2 12/1994 (EP) .
0 740 231 A1 10/1996 (EP) .
0 757 304 A2 2/1997 (EP) .
9-62167 3/1997 (JP) .

* cited by examiner

*Primary Examiner*—Sandra Brase
(74) *Attorney, Agent, or Firm*—Fitzpatrick, Cella, Harper & Scinto

(57) ABSTRACT

A coupling member for coupling a first frame for supporting an electrophotographic photosensitive member and a second frame for supporting a developing member for developing a latent image formed on the photosensitive member, the coupling member includes a base; a shaft mounting portion provided in the base to mount a shaft for rotatably coupling the first frame and the second frame; an urging portion, provided in the base, for urging, to the second frame, a resilient member for applying a resilient force between the first frame and the second frame; and a fixed portion, in the base, for fixing the base to the first frame.

112 Claims, 15 Drawing Sheets

COUPLING MEMBER, PROCESS CARTRIDGE AND ASSEMBLING METHOD OF PROCESS CARTRIDGE

FIELD OF THE INVENTION AND RELATED ART

The present invention relates to a coupling member, a process cartridge and an assembling method of a process cartridge.

Here, the process cartridge may be a cartridge which is detachably mountable to a main assembly of an image forming apparatus and which contains as a unit, an electrophotographic photosensitive member and developing means. The process cartridge may be a cartridge which is detachably mountable to a main assembly of an image forming apparatus and which contains as a unit, at least charging means for charging the electrophotographic photosensitive member and cleaning means for removing residual developer from the electrophotographic photosensitive member, as well as the developing means.

Here, the term electrophotographic image forming apparatus refers to an apparatus using an electrophotographic image formation type process to form an image on a recording medium. Examples of the electrophotographic image forming apparatus include an electrophotographic copying machine, an electrophotographic printer (laser beam printer, an LED printer or the like), a facsimile device and word processor.

The electrophotographic image forming apparatus, such as an electrophotographic copying machine or laser beam printer, includes a photosensitive drum. The photosensitive drum is subjected to known processes including charging, exposure, and development processes to form a toner image thereon, and the image thus formed is transferred onto a recording material, such as a transfer sheet. Thereafter, the toner remaining on the photosensitive drum is removed by a cleaning device.

In the electrophotographic image forming apparatus field, a process cartridge type is widely used, since this type is advantageous in that it permits downsizing and easy maintenance. The process cartridge is detachably mountable to a main assembly of an image forming apparatus by a user and contains as a unit, an electrophotographic photosensitive member or drum and at least one of process means, such as charging means, developing means, cleaning means, or the like.

A process cartridge comprising frames which are coupled with a coupling member, is known.

SUMMARY OF THE INVENTION

Accordingly, it is a principal object of the present invention to provide a coupling member, a process cartridge, and an assembling method for a process cartridge, wherein assembling operativity is improved.

It is another object of the present invention to provide a coupling member capable of easily coupling a first frame supporting an electrophotographic photosensitive member and a second frame for supporting a developing member for developing a latent image formed on the photosensitive member, a process cartridge, and an assembling method of the process cartridge using such a coupling member.

According to the present invention, there is provided a coupling member for coupling a first frame for supporting an electrophotographic photosensitive member and a second frame for supporting a developing member for developing a latent image formed on the photosensitive member, the coupling member comprising:

(a) a base;

(b) a shaft mounting portion provided in the base to mount a shaft for rotatably coupling the first frame and the second frame;

(c) an urging portion, provided in the base, for urging, to the second frame, a resilient member for applying a resilient force between the first frame and the second frame; and (d) a fixed portion, in the base, for fixing the base to the first frame.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

A process cartridge and an image forming apparatus using the process cartridge according to an embodiment of the present invention will be described in conjunction with the accompanying drawing.

Figure 1:
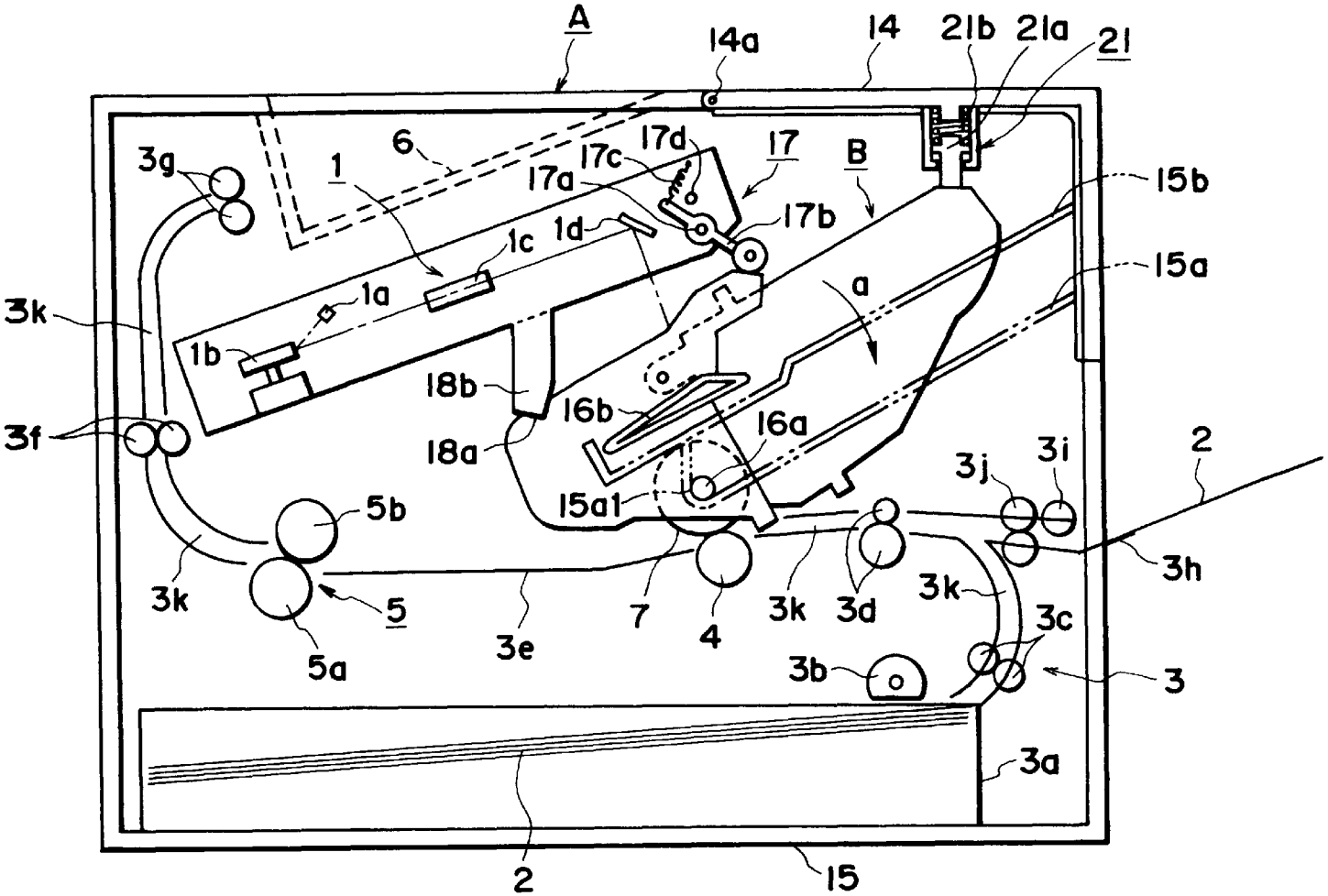
FIG. 1 is a longitudinal sectional view of a laser beam printer loaded with a process cartridge according to an embodiment of the present invention.

General Arrangement of a Process Cartridge and an Image Forming Apparatus Loaded with the Same The general arrangement of the image forming apparatus will be first described. FIG. 1 is a sectional illustration of a laser beam printer loaded with a process cartridge, as an exemplary image forming apparatus FIG. 2 is a sectional illustration of a process cartridge.

In this laser beam printer, as shown in FIG. 1, an electrophotographic photosensitive member of a drum configuration is exposed to a laser beam based on an image information supplied from an optical system 1 so that latent image is formed on the photosensitive member, and the latent image is developed with toner into a toner image. In synchronism with the formation of the toner image, a recording material 2 (recording sheet or the like) is fed by transporting means 3. The toner image formed on the photosensitive drum by an image formation station in a process cartridge B is transferred onto the recording material 2 by transferring means 4. The recording material 2 is fed to a fixing means 5, where the transferred toner image is fixed, and is discharged to a discharging portion 6.

Figure 2:
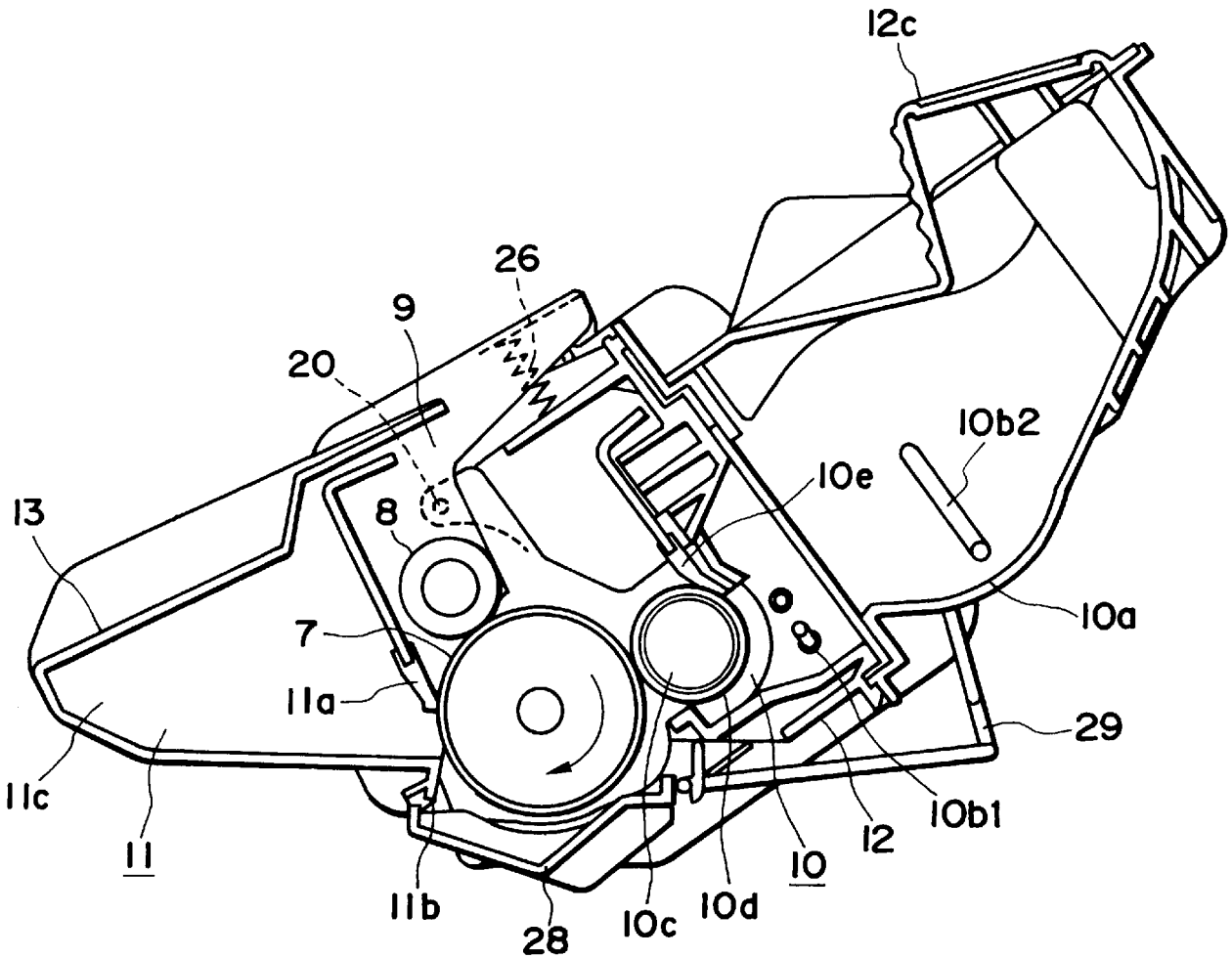
FIG. 2 is a longitudinal sectional view of a process cartridge.

In the process cartridge B constituting the image formation station, the photosensitive drum 7 functioning as an image bearing member is rotated, and the surface thereof is charged uniformly by charging means 8, as shown in FIG. 2. The light image from an optical system 1 is projected to a photosensitive drum 7 through an exposure opening 9 so that a latent image is formed, and the latent image is developed into a visualized toner image. After the toner image is transferred onto the recording material 2 by the transferring means 4, the remaining toner is removed from the photosensitive drum 7 by the cleaning means 11.

The process cartridge B comprises a first frame (cleaning frame 13) including the photosensitive drum 7, the cleaning means 11 and the like, and a second frame (toner developing device frame) including a toner container and a developing roller. The frames are coupled by coupling members which will be described hereinafter.

A description will be provided as to structures of each part of the image forming apparatus A and the process cartridge B.

Image Forming Apparatus

Various parts of the image forming apparatus A will be described.

Optical System

The optical system 1 projects a light image of image information read out of an external device, onto the photosensitive drum 7. As shown in FIG. 1, a laser diode 1*a*, a polygonal mirror 1*b*, an imaging lens 1*c* and a reflection mirror 1*d* constituting the optical system are contained in a housing.

When an image signal is supplied from an external device, the laser diode 1*a* emits a laser beam in accordance with the image signal, and the laser beam is directed to the polygonal mirror 1*b*. The polygonal mirror 1*b* is rotated at a high speed by a scanner motor directly connected thereto, and the image light reflected by the polygonal mirror 1*b* is projected onto the photosensitive drum 7 through the imaging lens 1*c* and the reflection mirror 1*d*, thus exposing the surface of the photosensitive drum 7 selectively Recording Material Feeding Means The feeding means 3 for feeding the recording material 2 will be described. The recording material 2 can be fed manually, or fed automatically from a cassette. In the manual feeding structure, as shown in FIG. 1, the recording material 2 is set in a sheet feeding tray 3*h*, and image formation is started. Then, the recording material 2 is fed into the main assembly 15 of the apparatus by a pick-up roller 3*i* from the sheet feeding tray 3*h*. The recording material is fed, one by one, by a pair of separation rollers 3*j*, and the leading edge of the recording material 2 abuts the pair of the registration rollers 3*d*. The registration rollers are then rotated in synchronism with the image forming operation to feed the recording material 2 into between the photosensitive drum 7 and the transfer roller 4. The toner image is transferred onto the recording material 2 between the photosensitive drum 7 and the transfer roller 4. The recording material 2, after the image transfer, is fed into the fixing means 5 through a feeding path 3*e*, and the toner image is fixed on the recording material 2 by the fixing means 5. The recording material is discharged out to the discharging portion 6 by a pair of discharging roller 3*f* and 3*g*. A guiding member 3*k* is provided between the rollers to guide the recording material 2.

On the other hand, as a structure for feeding the recording material from the cassette, there is provided a mounting portion for a sheet feeding cassette 3*a* at a bottom portion in the main assembly 15 of the apparatus as shown in FIG. 1. When the recording material 2 is not fed manually, the recording material 2 is picked up from the cassette 3*a* loaded in the mounting portion by a pick-up roller 3*b* and is fed by a feeding roller 3*c* one by one to the registration rollers. After that recording material is fed in the same manner as with the recording material manually fed.

Transferring Means

The transferring means 4 functions to transfer the toner image onto the recording material 2 from the photosensitive drum 7, and the transferring means 4 of this embodiment includes a transfer roller 4. Thus, the recording material 2 is pressed onto the photosensitive drum 7 of the process cartridge B by the transfer roller 4. The transfer roller 4 is supplied with a voltage having a polarity opposite from that of the toner image formed on the photosensitive drum 7, so that the toner image is transferred from the photosensitive drum 7 onto the recording material 2.

Fixing Means

The fixing means 5 functions to fix the toner image which has been transferred onto the recording material 2 by voltage application to the transfer roller 4. As shown in FIG. 1, it comprises a driving roller 5*a* and a fixing roller 5*b* press-contacted to and driven by the driving roller 5*a*, the fixing roller 5*b* including therein a heat generating member. When the recording material 2 having the transferred toner image is passed through a nip between the driving roller 5*a* and the fixing roller 5*b*, the recording material 2 is pressed by the rollers 5*a*, 5*b*, and is heated by the heat generation in the fixing roller 5*b*. By this, the toner image is fixed on the recording material 2.

Process Cartridge

In the process cartridge B of this embodiment, as shown in FIG. 2, the electrophotographic photosensitive drum 7 having the photosensitive layer is rotated, and the surface thereof is uniformly charged by voltage application to the charging roller 8 (charging means). After the surface is charged, it is exposed to the light image supplied from the optical system 1, through the exposure opening 9, so that latent image is formed, and the latent image is developed by the developing device 10.

The developing device 10 feeds the toner from a toner accommodating portion 10*a* by a first rotatable feeding member 10*b*1 and a second feeding member 10*b*2. A developing roller 10*d*, which is a developing roller containing therein a fixed magnet 10*c*, is rotated, and a toner layer having triboelectric charge provided by developing blade 10*e* is formed on the surface of the developing roller 10*d*. The toner is transited onto the photosensitive drum 7 in accordance with the latent image so that visualized toner image is formed.

After the toner image is transferred onto the recording material 2 by the application of the voltage of the opposite polarity to the transfer roller 4, the residual toner is removed from the photosensitive drum 7 by the cleaning means 11. More particularly, the toner remaining on the photosensitive drum 7 is scrapped off by a cleaning blade 11*a,* and the removed toner is received by a receptor sheet 11*b* and is collected in a residual toner accommodating portion 11*c*. At a contact portion between the photosensitive drum 7 and the transfer roller 4, the cartridge frame has an opening, which can be closed by a drum shutter 28. The drum shutter 28 has a quadric link mechanism having a fixed portion which is the cartridge frame, and the drum shutter 28 is supported by a link 29 and other links (arms not shown).

The elements, such as the photosensitive drum 7, are contained in a cartridge frame constituted by coupling a toner developing device frame comprising as a unit a developing device frame 12, cap 12*c* and a toner accommodating portion 10*a* and a toner frame welded together, and a cleaning frame 13. The cartridge is detachably mountable relative to the cartridge mounting means in the main assembly 15 of the apparatus.

More particularly, the cleaning frame 13 and the developing device frame 12 are rotatably coupled by a shaft portion 20, and a compression coil spring 26 is disposed compressed between the cleaning frame 13 and the developing device frame 12. By the weight of the toner developing device frame and the spring force of the compression coil spring 26, a spacer roller having a diameter larger than the developing roller 10*d* (unshown) and provided at each of the ends of the developing roller 10*d*, is press-contacted to the photosensitive drum 7 to define a developing gap.

The cleaning frame 13 and the developing device frame 12 are made of plastic resin material. The plastic resin material may include polystyrene, ABS resin material (acrylonitrile/butadiene/styrene copolymer resin material), polycarbonate, polyethylene and polypropylene.

Mounting-and-Demounting Structure of the Process Cartridge

A description will be provided as to the structure for mounting and demounting of the process cartridge B relative to the image forming apparatus A.

When the process cartridge B is mounted or demounted, an openable member 14 is opened. When the openable member 14 as the cartridge mounting means is rotated about the shaft 14*a* to open it, guide rails 15*a*, 15*b* in the form of aprons are seen at both of the lateral side of the cartridge mounting space.

Figure 3:
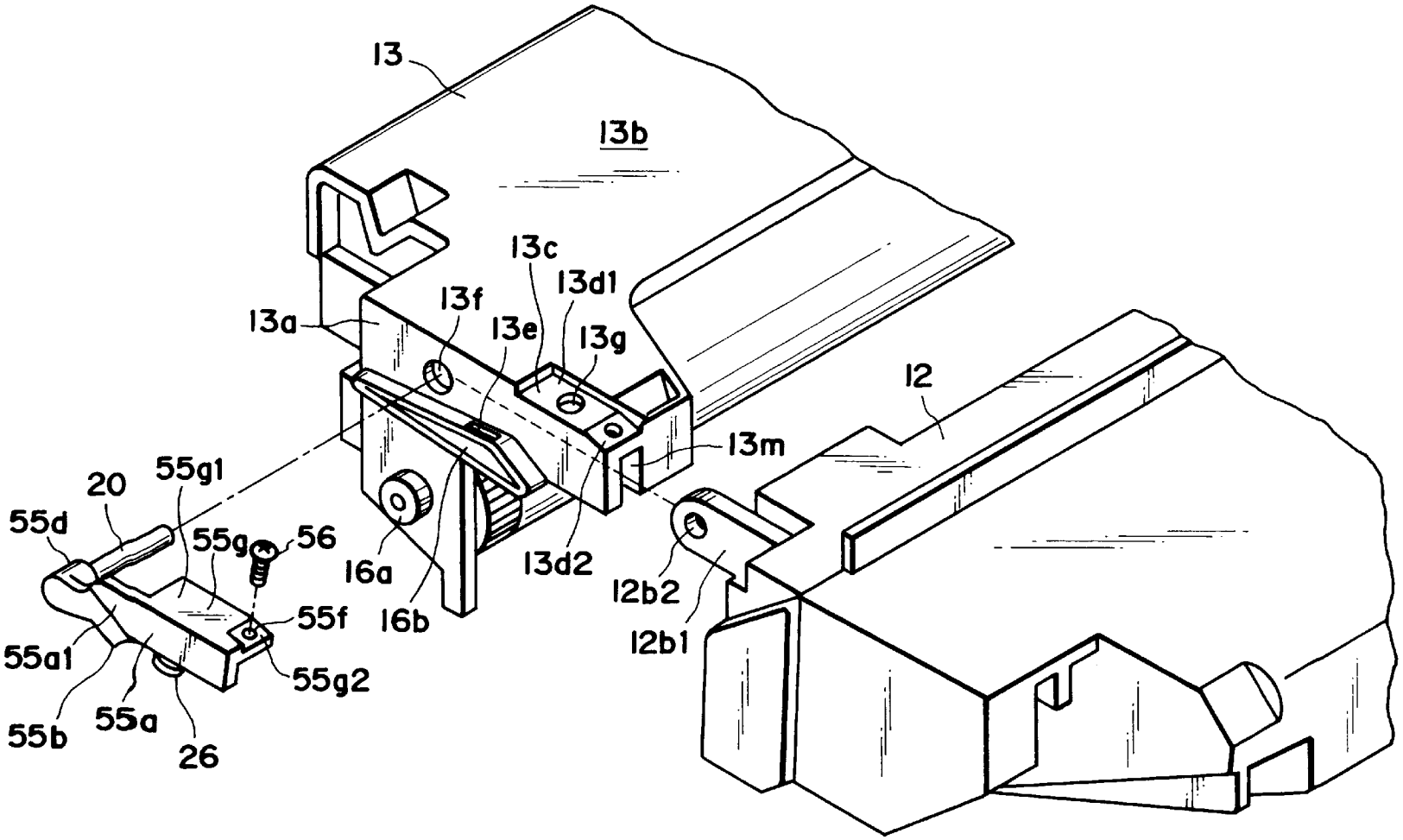
FIG. 3 is an exploded perspective view of a frame coupling in the process cartridge according to the first embodiment of the present invention.

Corresponding to the guide rails 15*a*, 15*b*, guide portions are provided at both of the ends of the process cartridge B along the guide rails 15*a*, 15*b*. The guide portions are projected at symmetrical positions (in the direction of the cartridge frame), and include a boss 16*a* as a first guide portion and a rib 16*b* as a second guide portion, as shown in FIGS. 1, 3. The opposite longitudinal end has the same guiding portion, although it is not shown. The boss 16*a* part is disposed on an extension line of the rotation shaft of the photosensitive drum 7, and the rib 16*b* is above the boss 16*a*. At the center of the boss 16*a*, an end of the drum shaft for supporting the photosensitive drum 7 is exposed outwardly to function as a grounding contact (unshown) of a cartridge.

With this structure, when the process cartridge B is to be mounted, it is slid below the optical system 1 of the apparatus so that boss 16*a* and the rib 16*b* move along the guide rails 15*a*, 15*b*.

When the process cartridge B is inserted, the contact surface 18*a* adjacent each of the opposite ends of the leading end portion of the cleaning frame 13 is abutted to the abutment member 18*b* provided in the main assembly 15 of the apparatus. Then the process cartridge B is rotated in the direction of arrow a, so that boss 16*a* of the process cartridge B falls in the recess 15*a*1 formed at a terminal end portion of the guide rail 15*a*. By this, a drum gear (unshown) fixed to an end of the photosensitive drum 7 is brought into meshing engagement with a driving gear (unshown) of the main assembly 15, so that driving force becomes transmittable from the main assembly to the process cartridge B. Before the process cartridge B is mounted in this manner, a projected portion of a link 29 supporting a drum shutter 28 is blocked from entering so as to open the drum shutter 28.

When the process cartridge B is mounted to the main assembly 15 of the apparatus, one end of the lever 17*b* of the urging means 17 journaled to the main assembly 15 pushes the upper surface at the right side of the boss 16*a* in FIG. 1. The other end of the lever 17*b*, which is journaled at its middle portion on the main assembly 15*a* of the apparatus by a pin 17*a*, is urged by a tension coil spring 17*c* so that lever 17*b* is urged for the clockwise rotation. The rotation of the lever 17*b* by the coil spring 17*c* is limited by the stopper 17*b*.

When the openable member 14 is closed, it is urged downwardly by the compression coil spring 21*b* of the urging means 21 provided on the openable member 14, and an upper portion of the process cartridge B at the trailing side, with respect to the mounting direction, is pressed by the pin 21*a* supported for vertical movement. Thus, the process cartridge B is correctly positioned in the main assembly 15.

Figure 4:
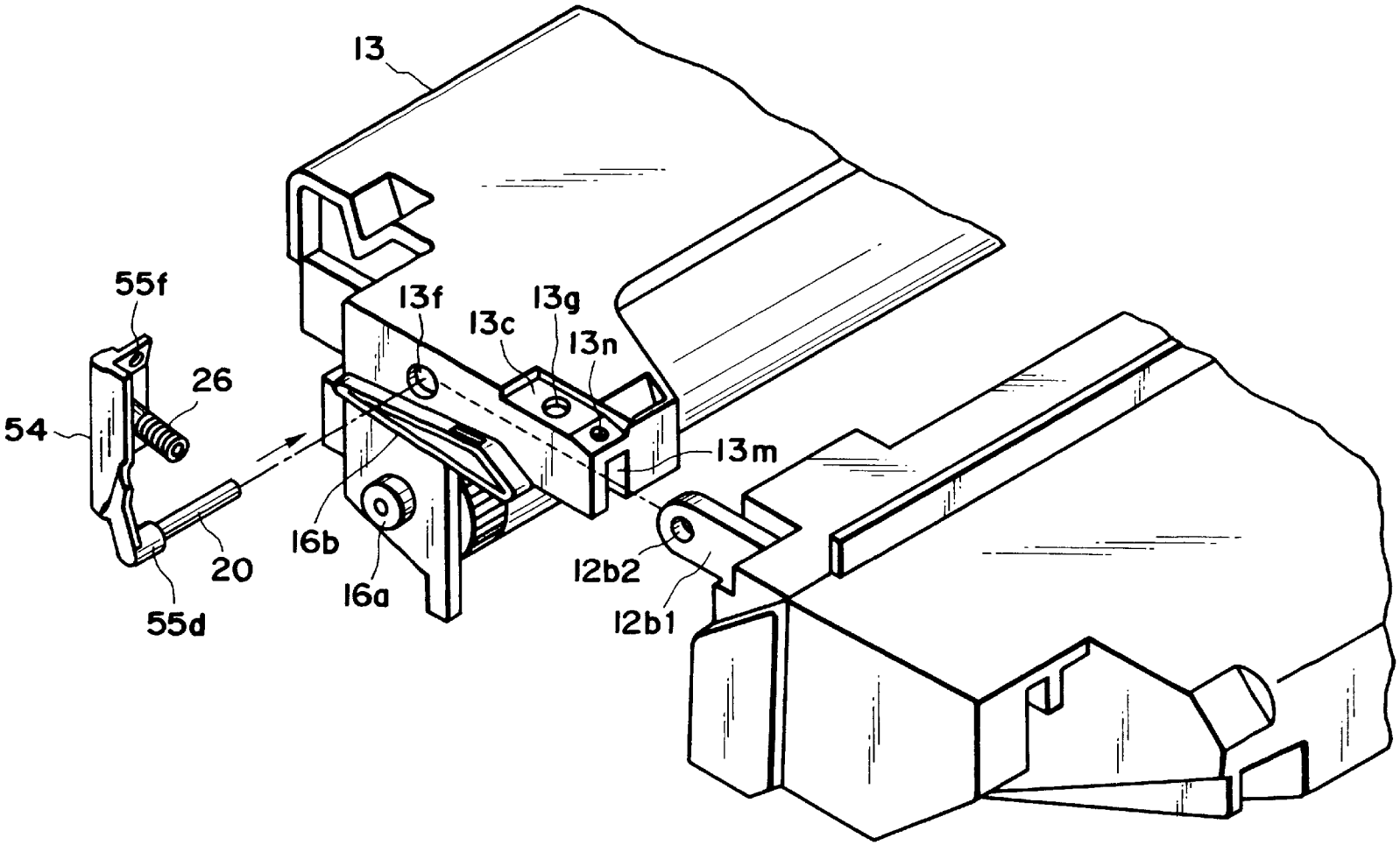
FIG. 4 is a perspective view illustrating assembling of the process cartridge.
Figure 5:
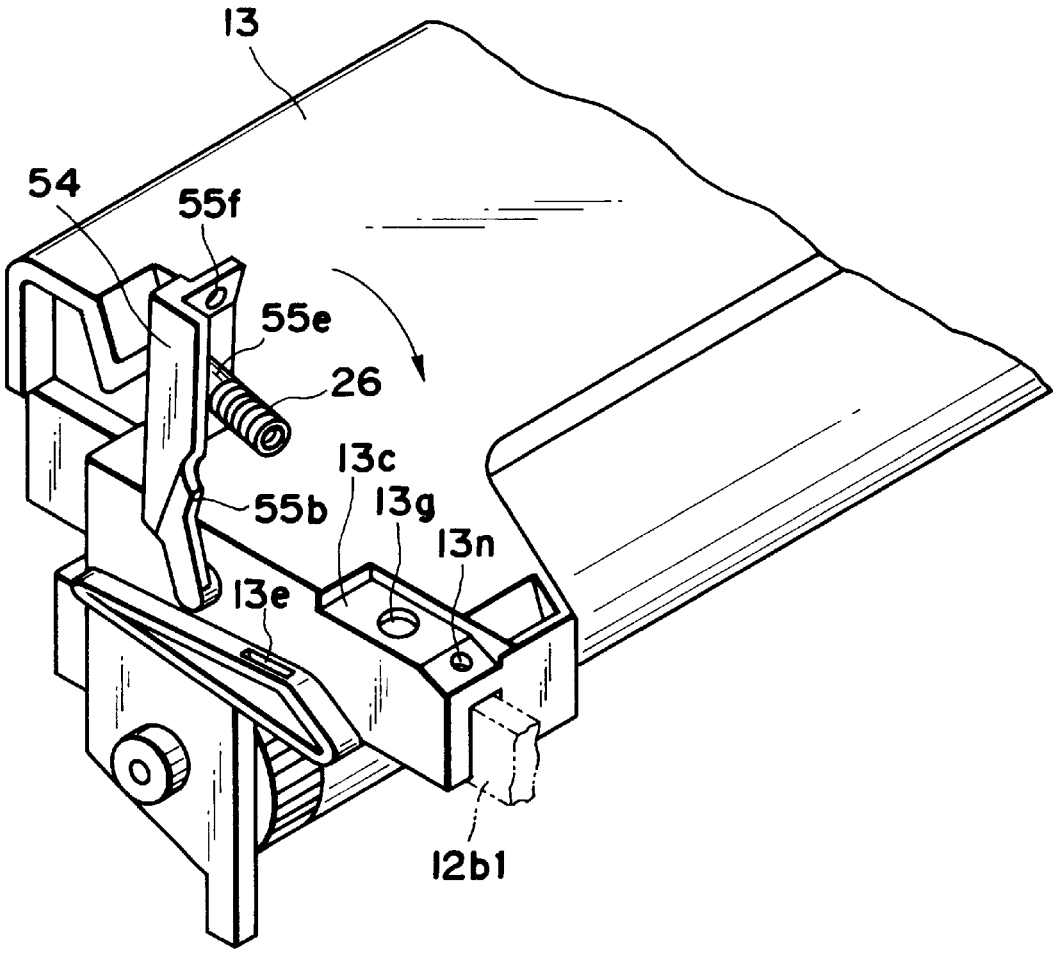
FIG. 5 is a perspective view illustrating assembling of the process cartridge.
Figure 6:
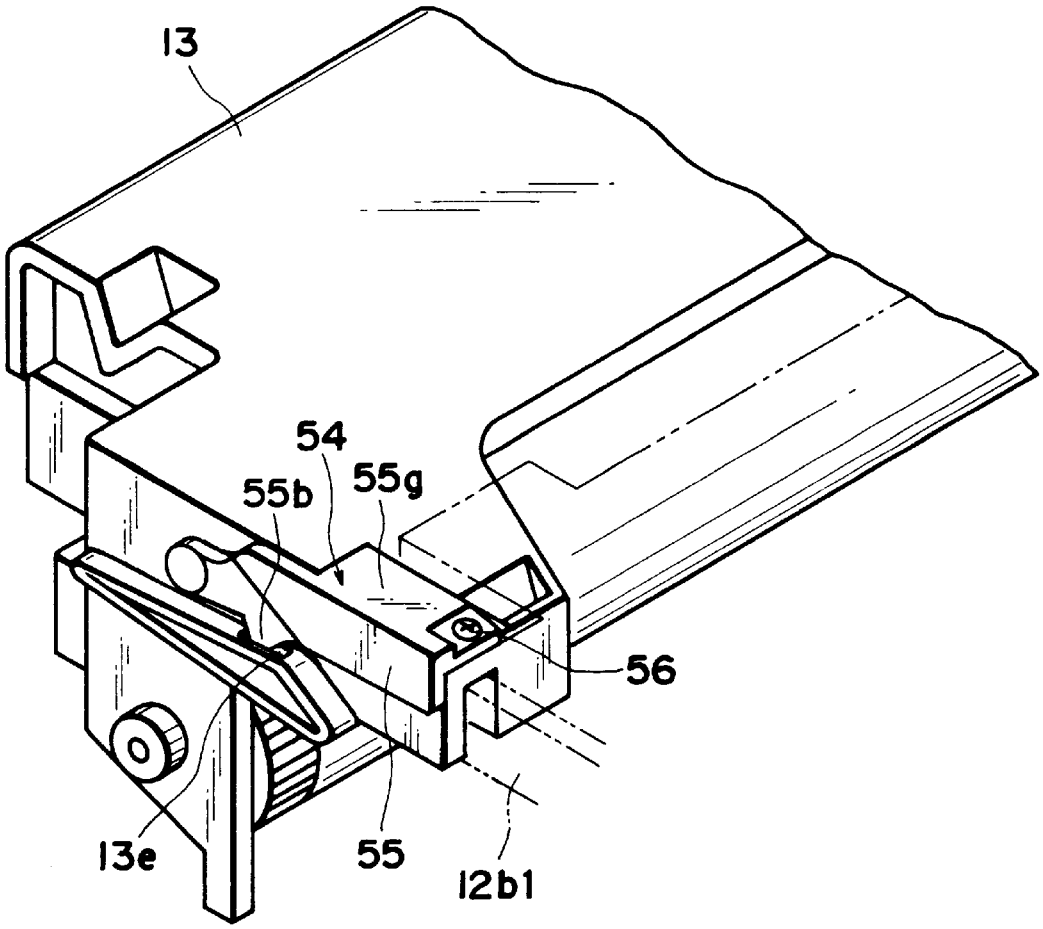
FIG. 6 is a perspective view illustrating an assembling state of a process cartridge.

Referring to FIGS. 3–10, a description will be provided as to a coupling structure between the cleaning frame 13 (the first frame) supporting the photosensitive drum and the developing device frame 12 (the second frame) supporting the developing roller 10*d*. The developing device frame 12 is coupled with the toner frame, and is integral with the toner frame. FIGS. 3, 4 are exploded perspective views before the first frame and the second frame are coupled with the coupling member. FIGS. 5, 6 are perspective views after the first frame and the second frame are coupled by the coupling member. In FIGS. 5 and 6, only a part of the developing device frame 12 is indicated by chain lines.

Figure 7:
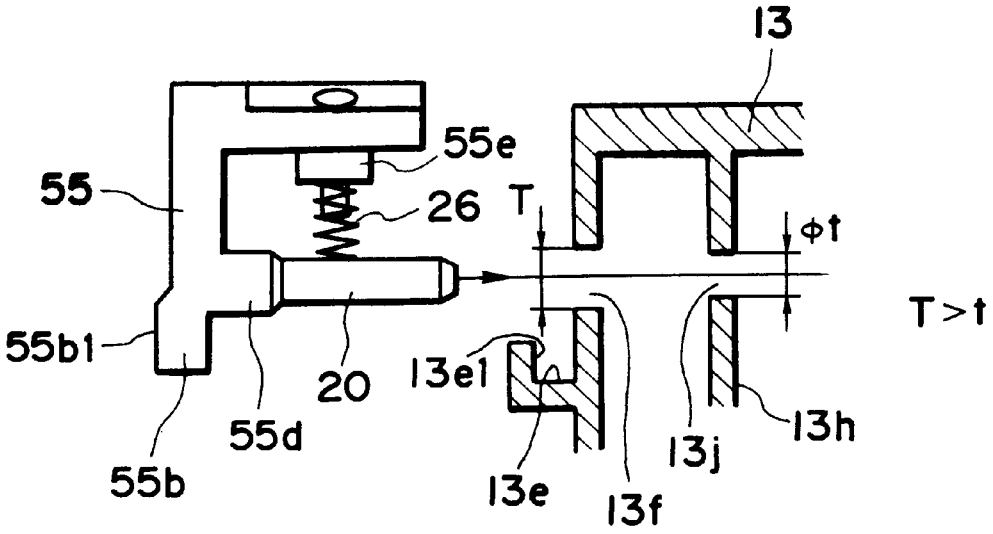
FIG. 7 is a longitudinal sectional view illustrating a relation of a cleaning frame and a coupling member of a process cartridge.
Figure 8:
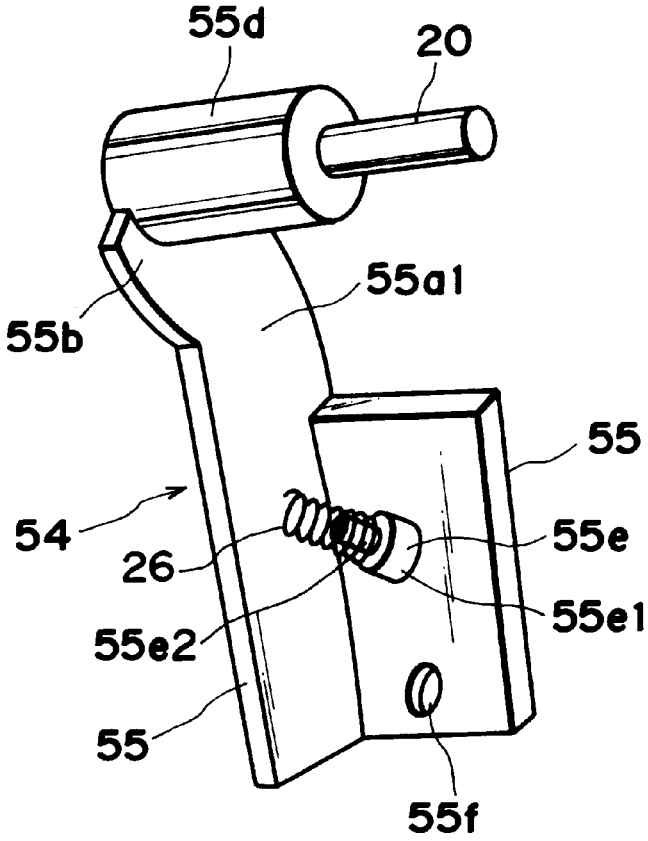
FIG. 8 is a perspective view of a coupling member.
Figure 9:
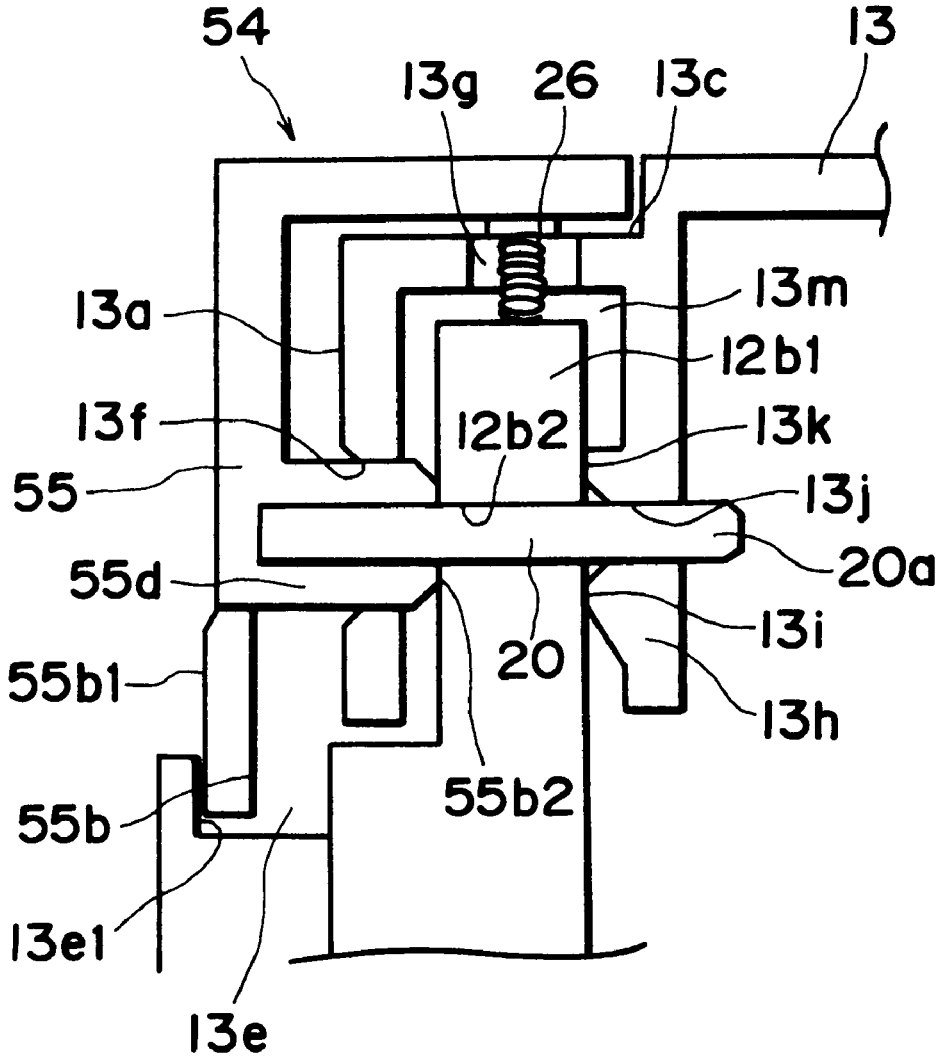
FIG. 9 is a longitudinal sectional view of a frame connecting portion of a process cartridge.
Figure 10:
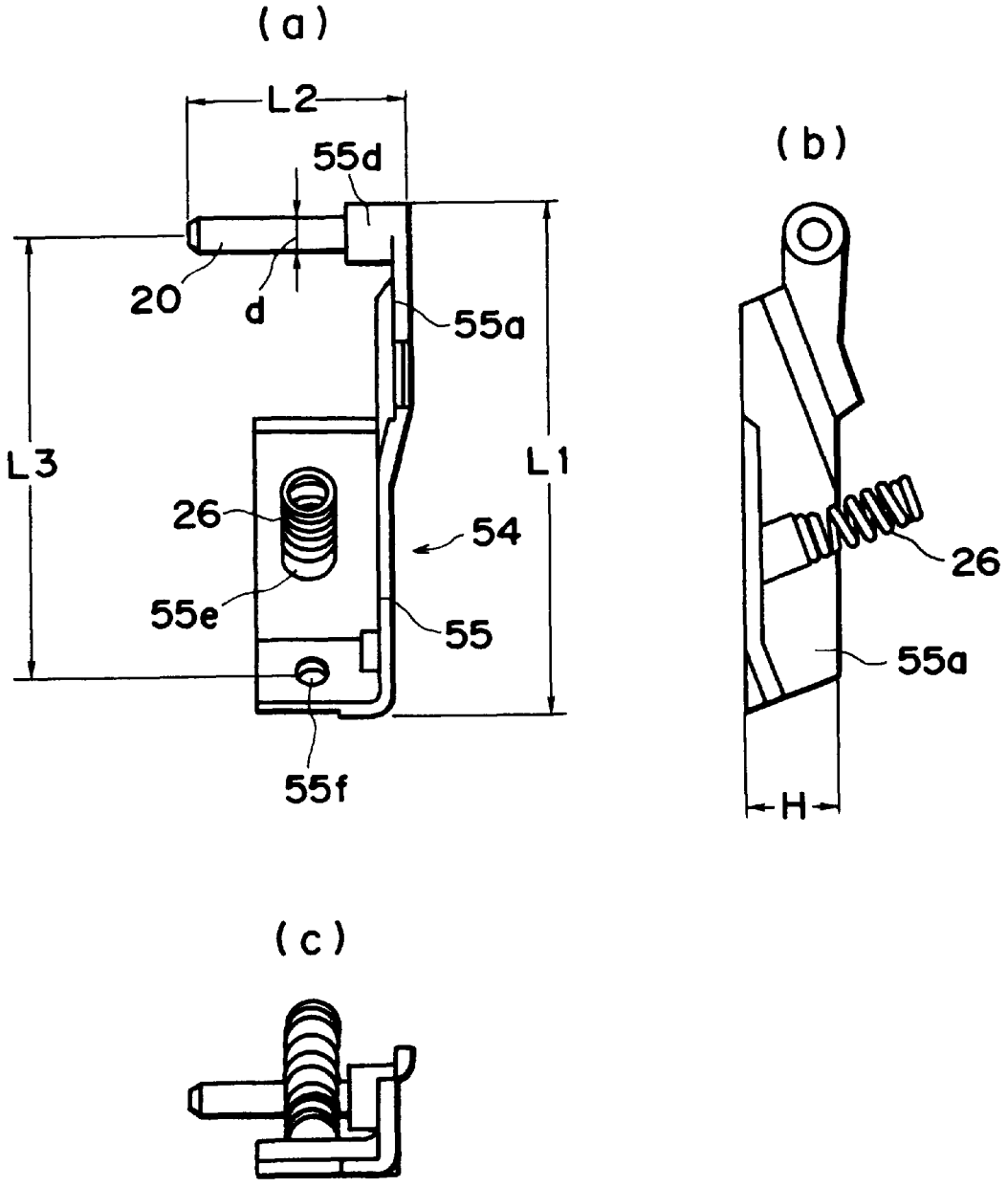
FIG. 10 shows a coupling member, wherein (a) is a bottom view, (b) is a side view, and (c) is a front view.
Figure 11:
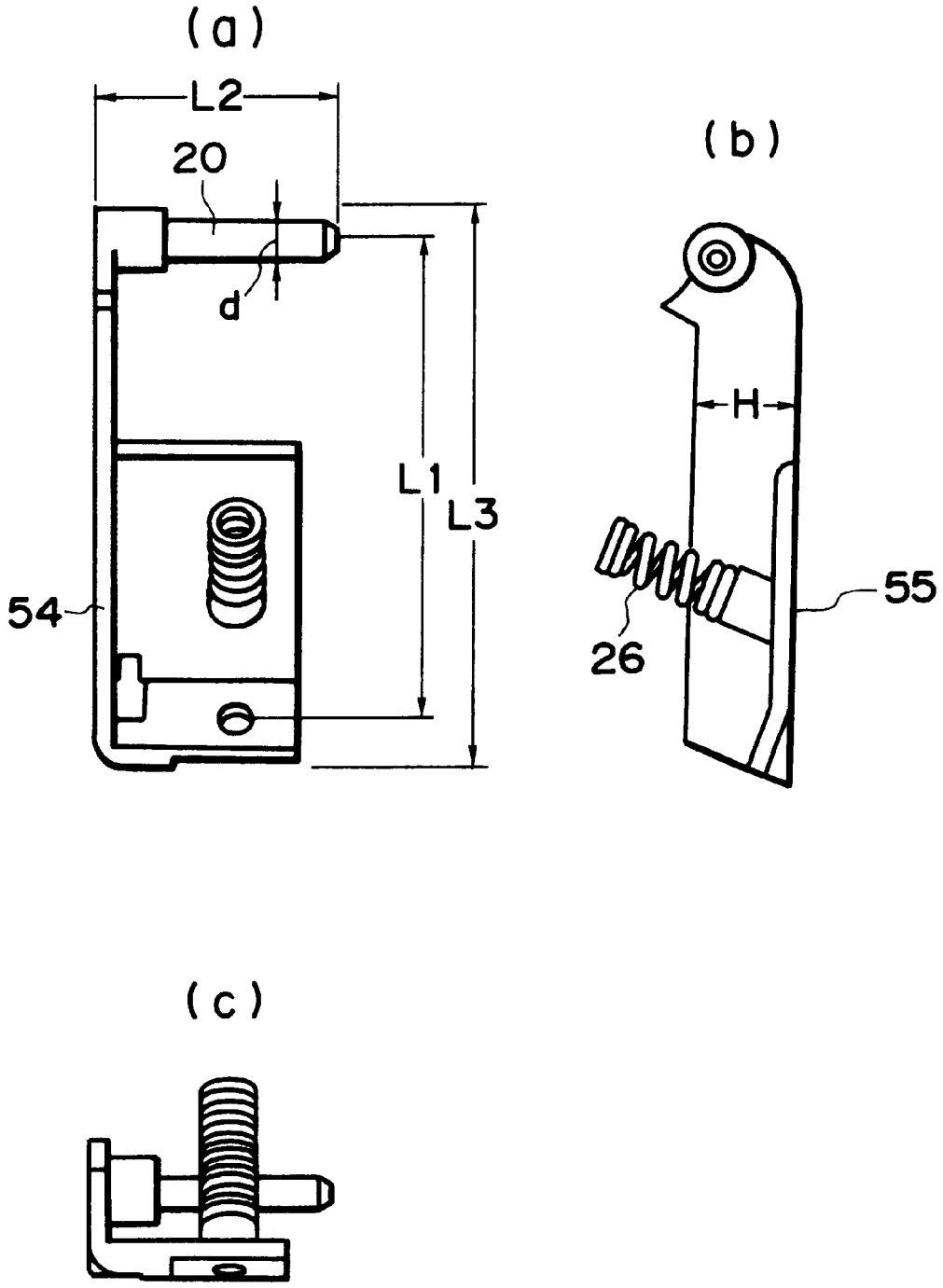
FIG. 11 shows a right-hand side coupling member, wherein (a) is a bottom view, (b) is a side view, and (c) is a front view.

FIG. 7 is a schematic sectional view of a connecting portion between the first frame and the second frame. FIG. 8 is a perspective view of a coupling member alone. FIG. 9 is a longitudinal sectional view of the connecting or coupling portion between the first frame and the second frame. FIGS. 10 and 11 show the coupling member. As shown in FIG. 8, the coupling member 54 includes a compression coil spring 26 for urging the developing roller 10*d* toward the photosensitive drum 7 and a spring supporting portion 55*e* for supporting the compression coil spring 26. It further includes a shaft portion 20 for rotatably coupling the fixing member 55, the developing device frame 12 and the cleaning frame 13, and includes a second shaft portion 55*d* for supporting the shaft portion 20 and for supporting opposite longitudinal ends of the developing device frame 12. It further includes a hole 55*f* for fixing the fixing member 55 which is a main body of the coupling member 54 to the cleaning frame 13, and a retainer portion 55*b* provided in the fixing member 55 to retain the coupling member 54.

The configuration of the coupling member 54 will be described. As shown in FIG. 3, the fixing member 55 has a side portion 55*a* in the form of a plate extending substantially vertically when the coupling member is mounted, and the side portion 55*a* is provided parallel with and adjacent to a vertical side surfaces 13*a* of each of the longitudinal ends of the cleaning frame 13. An upper portion 55*g* is extended from the side portion 55*a* and is bent longitudinally inwardly. It has a substantially horizontal plate-like shape. The section taken along a longitudinal and vertical plane of the upper portion 55*g* and side portion 55*a* is substantially L-shaped. The upper portion 55*g* has a shape and dimensions snugly fitting on the recessed seat 13*c* provided at an upstream corner as seen from an inserting direction of the process cartridge B, at each of left and right ends of the upper surface 13*b* of the cleaning frame 13. The upper portion 55*g* of the fixing member 55 has a longitudinal edge line between slightly bent first upper portion 55*g*1 and second upper portion 55*g*2. For conformity with this configuration, the bottom surface of the recessed seat 13*c* of the frame 13 has a first bottom surface 13*d*1 and a second bottom surface 13*d*2. The portion providing the bottom surfaces 13*d*1 and 13*d*2 is in the form of a plate. The depth of the recess 13*c* of the cleaning frame 13 and the thickness of the upper portion 55*g* of the fixing member 55 are substantially the same. The side portion 55*a* of the fixing member 55 has a portion 55*a*1 extended in the inserting direction of the process cartridge B when it is mounted to the cartridge frame. The extension 55*a*1 is provided with a circular second shaft portion 55*d* directed longitudinally inwardly of the cleaning frame 13. A retainer portion 55*b* is provided at the bottom of the extension 55*a*1. The retainer portion 55*b* is slightly offset longitudinally outwardly beyond the side portion 55*a*. The retainer portion 55*b* is engaged with a retaining groove 13*e* dug down between the side surface 13*a* of the cleaning frame 13 and the upper surface of the rib 16*b*, so that fixing member 55 is retained and correctly positioned in the longitudinal direction. The second upper portion 55*g*2 of the fixing member 55 is provided with a through hole 55*f* for a small screw 56.

As shown in FIGS. 7, 8, the lower surface of the upper portion 55*g* of the fixing member 55 of the coupling member 54 is provided with a projection functioning as a spring supporting portion 55*e* for fastening the compression coil spring 26. The spring supporting portion 55*e* is a stepped dowel including a large diameter portion 55*e*1 providing a seat for the spring, and a small diameter portion 55*e*2 around which the compression coil spring 26 is press-fitted. The axis of the spring supporting portion 55*e* is aligned with a center line of the compression coil spring 26 press-fitted around the small diameter portion 55*e*2, and the center line is perpendicular to the upper surface of the arm portion 12*b*1 of the developing device frame 12 shown in FIG. 3 when the compression coil spring 26 is press-fitted, in the state after the process cartridge is assembled. The hole portion 55*f* and the spring supporting portion 55*e* have their centers in a plane perpendicular to the longitudinal direction. The spring supporting portion 55*e* is disposed between the hole portion 55*f* and the shaft portion 20.

The shaft portion 20 is cylindrical and has its axis extending in the longitudinal direction, and is at the center of the second shaft portion 55*d*.

When the coupling member 54 is mounted in the manner described above, the shaft portion 20 is extended longitudinally and horizontally, and the compression coil spring 26 extends vertically, in the state wherein the process cartridge B is mounted to the main assembly 15. Thus, the shaft portion 20 and the compression coil spring 26 are crossed with each other without a crossing point.

As shown in FIG. 3, the cleaning frame 13 is provided at each of the longitudinal ends with a recess 13*m* for engagement with an arm portion 12*b*1 projected toward the cleaning frame 13 at each of the longitudinal ends of the developing device frame 12. The side portion 13*a* of the cleaning frame 13 is provided with an outer through hole 13*f* toward the recess 13*m*, for engagement with the second shaft portion 55*d* of the coupling member 54. The first bottom surface 13*d*1 of the recessed seat 13*c* is provided with a round hole 13*g* for receiving the compression coil spring 26. The round hole 13*g* is disposed right above the middle of the arm portion 12*b*1 in the state when the arm portion 12*b*1 is in the recess 13*m*.

As shown in FIG. 9, a middle wall 13*h* is provided and is parallel with the side surface 13*a* of the cleaning frame 13, and the recess 13*m* is defined by the middle wall 13*h* and the side surface 13*a* therebetween. From the middle wall 13*h*, a circular boss 13*i* is projected outwardly, and the boss 13*i* has, at its center, an inner through-hole 13*j* for engagement with the shaft portion 20. The end surface of the boss 13*i* functions as an abutment 13*k* for correct positioning.

As shown in FIG. 9, the outer surface 55*b*1 of the retainer portion 55*b* is in contact with the outer side surface 13*e*1 of the retaining groove 13*e*, in the state when the retainer portion 55*b* of the coupling member 54 is engaged with the retaining groove 13*e* provided at each side of the cleaning frame 13. As shown in FIG. 9, the end surface of the second shaft portion 55*d* functions as an abutment 55*b*2 relative to the side surface of the outside of the arm portion 12*b*1. The other abutment surface 13*k* of cleaning frame 13 contracts to the inside surface of the arm portion 12*b*1. Thus, the developing device frame 12 and the cleaning frame 13 are correctly positioned in the longitudinal direction. At the other longitudinal end (opposite from the end shown in FIG. 9), there may be a gap between the arm portion 12*b*1 and the abutment surface 55*b*2 and/or 13*k*.

A description will be provided as to the assembling of the cleaning frame 13 and the developing device frame 12 having the above-described structure. The developing device frame 12 supports a developing roller 10*d* containing therein a fixed magnet 10*c* and a developing blade 10*e* or the like. The developing member 12 is coupled with a toner accommodating portion 10*a* having a welded cap 12*c*, and the toner accommodating portion 10*a* contains toner, thus constituting a developing unit.

The cleaning frame 13 supports the charging roller 8, the cleaning blade 11*a*, the receptor sheet 11*b*, the photosensitive drum 7 or the like, thus constituting a cleaning unit.

When an arm portion 12*b*1 of the developing device frame 12 is inserted into the recess 13*m* of the cleaning frame 13 to abut the bottom of the recess 13*m*, the hole 12*b*2 formed at the center of the semicircular free end of the arm portion 12*b*1 is slightly beyond the position at which it is exactly aligned with the inner through-hole 13*j*, but they are generally aligned.

As shown in FIG. 4, the shaft portion 20 of the coupling member 54 is aligned with the longitudinal direction, and the beveled end of the shaft portion 20 forces to the outer through-hole 13*f*. The hole 55*f* side is raised such that free end of the compression coil spring 26 in the free state is above the recessed seat 13*c* of the cleaning frame 13, and the shaft portion 20 is inserted through the outer through-hole 13*f* and is engaged into the hole 12*b*2 of the arm portion 12*b*1. Immediately after the insertion into the inner through-hole 13*j*, the second shaft portion 55*d* enters the outer through-hole 13*f*. With further insertion, the abutment surface 55*b*2 of the second shaft portion 55*d* urges the outer surface of the arm portion 12*b*1 to move the arm portion 12*b*1 and therefore the developing unit moves toward the right, so that inner surface of the arm portion 12*b*1 abuts the surface 13*k* of the cleaning frame 13. Here, the coupling member 54 is rotated about the shaft portion 20 and the second shaft portion 55*d*. Then, the compression coil spring 26 enters the round hole 13*g*, so that end of the compression coil spring 26 (resilient member) abuts the arm portion 12*b*1 of the developing device frame 12, as shown in FIG. 5 by an arrow. With further rotation of the coupling member 54, the compression coil spring 26 is compressed, and the developing device frame 12 is rotated about the first shaft portion 20 and the second shaft portion 55*d*, and the spacer rollers of the developing roller 10*d* are abutted to the photosensitive drum 7. As shown in FIG. 6, when the upper portion 55*g* of the frame coupling member 54 is pressed, the upper portion 55*g* is seated on the recessed seat 13*c* of the cleaning frame 13. Here, while the upper portion is kept pressed toward the recessed seat 13*c*, the small screw 56 is threaded into the screw 13*n* through the hole 55*f*, so that fixing member 55 of the frame coupling member 54 is fixed to the cleaning frame 13. When the fixing member 55 of the coupling member 54 is pressed to the recessed seat 13*c* of the cleaning frame 13 against the spring force of the compression coil spring 26, a retainer portion 55*b* in the form of a rib is engaged with the retaining groove 13*e*.

The compression coil spring 26 may be inserted into the round hole 13*g* rather than mounting it to the coupling member 54.

In the disassembling operation, the small screw 56 is dismounted while the upper portion 55*g* of the fixing member 55 is kept pressed. Then, the pressing force is reduced, and the compression coil spring 26 springs back to rotate the coupling member 54 upwardly about the first shaft portion 20 and the second shaft portion 55*d*. After the compression coil spring 26 expands to its free length, the fixing member 55 is raised, and then the coupling member 54 rises by rotation about the shaft portion 20 and the second shaft portion 55*d*, so that compression coil spring 26 extends beyond the round hole 13*g* of the seat portion 13*c* of the cleaning frame 13. When the coupling member 54 is pulled outwardly in the longitudinal direction, the second shaft portion 55*d* is removed from the outer through-hole 13*f*, and then the first shaft portion 20 is removed from the inner through-hole 13*j* and the hole 12*b*2 of the arm portion 12*b*1. As a result, the cleaning frame 13 and the developing device frame 12 are released from each other so that arm portion 12*b*1 can be pulled out from the recess 13*m* of the cleaning frame 13.

Figure 12:
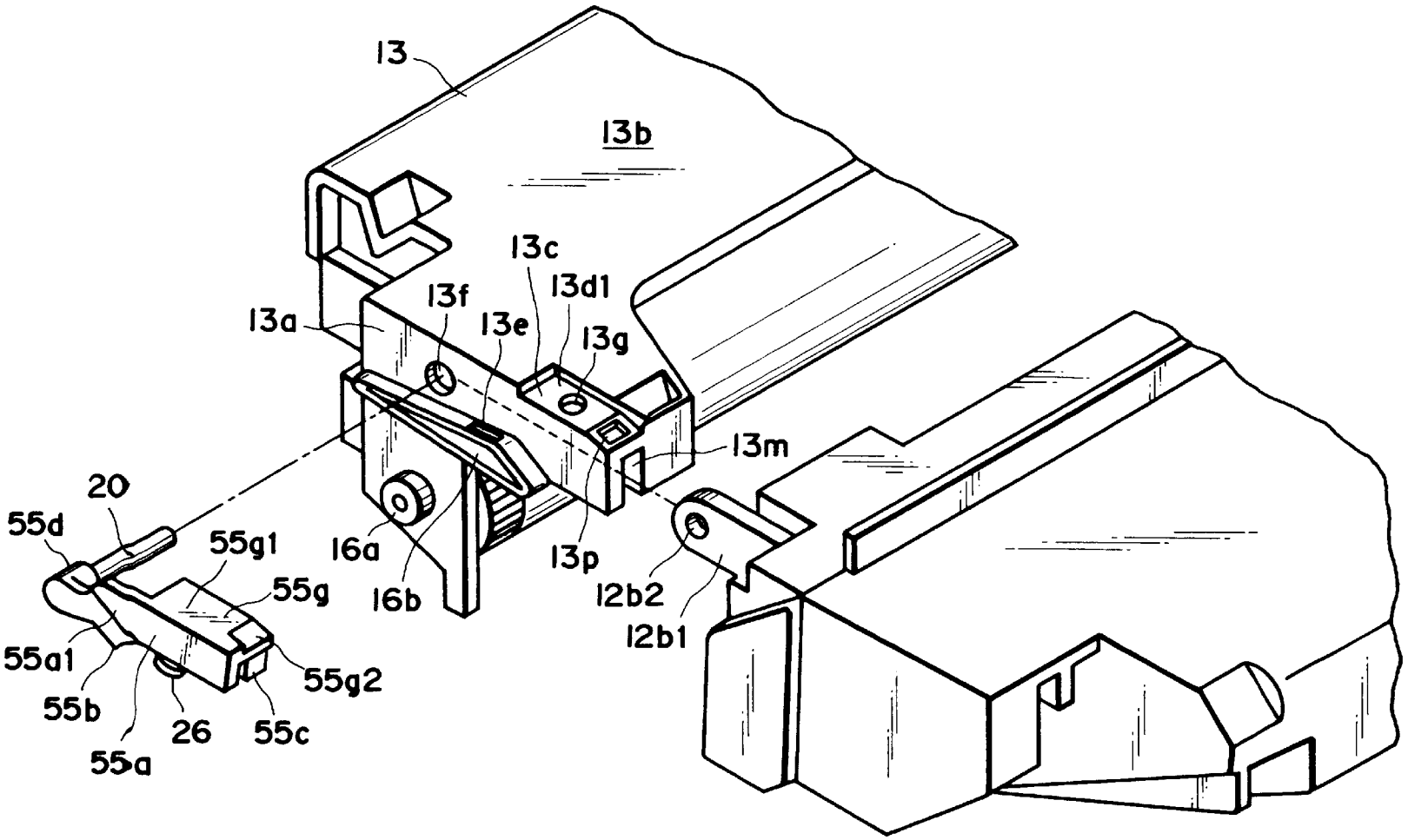
FIG. 12 is a perspective view of a modified example of the Embodiment 1.
Figure 17:
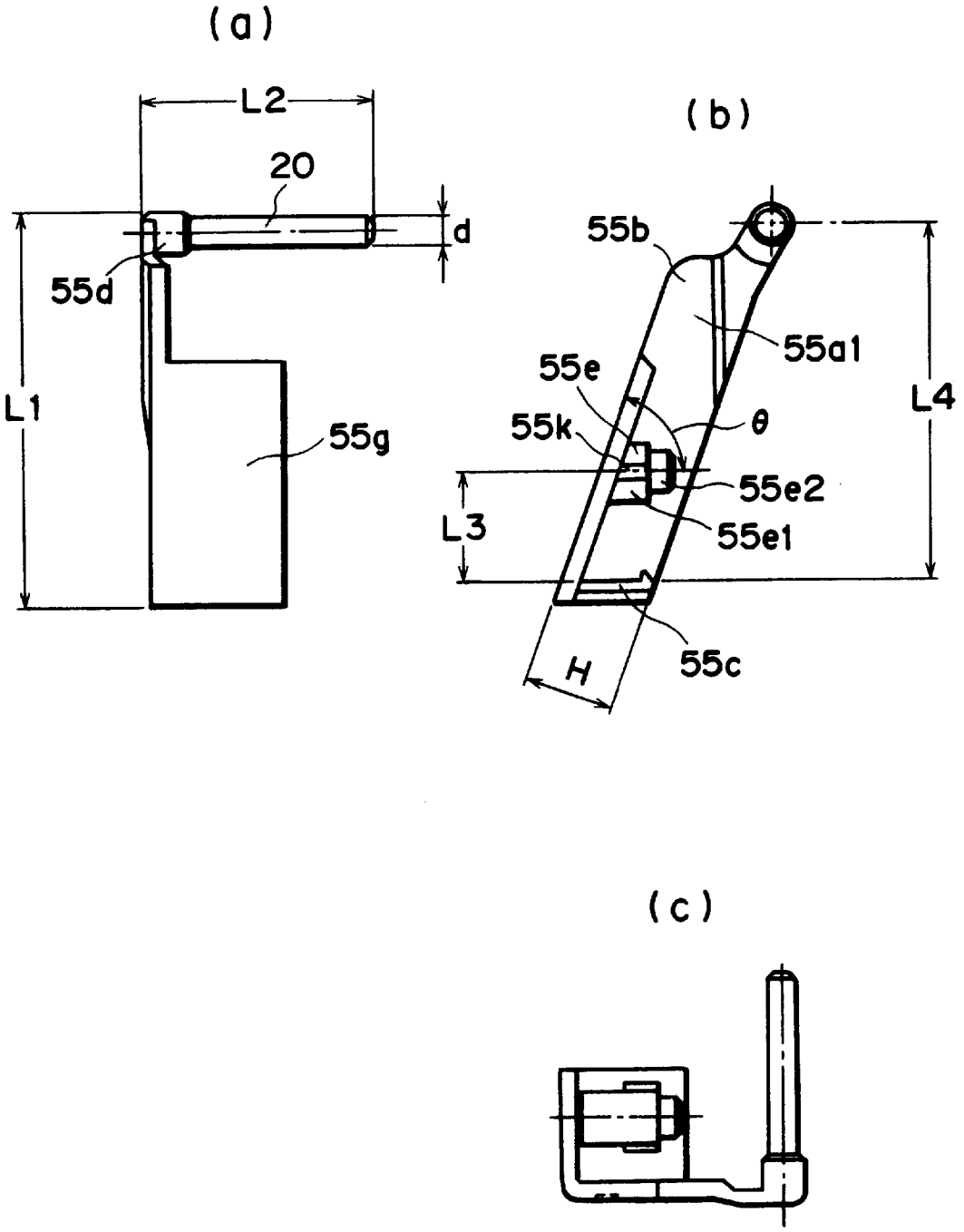
FIG. 17 shows a left side coupling member.
Figure 18:
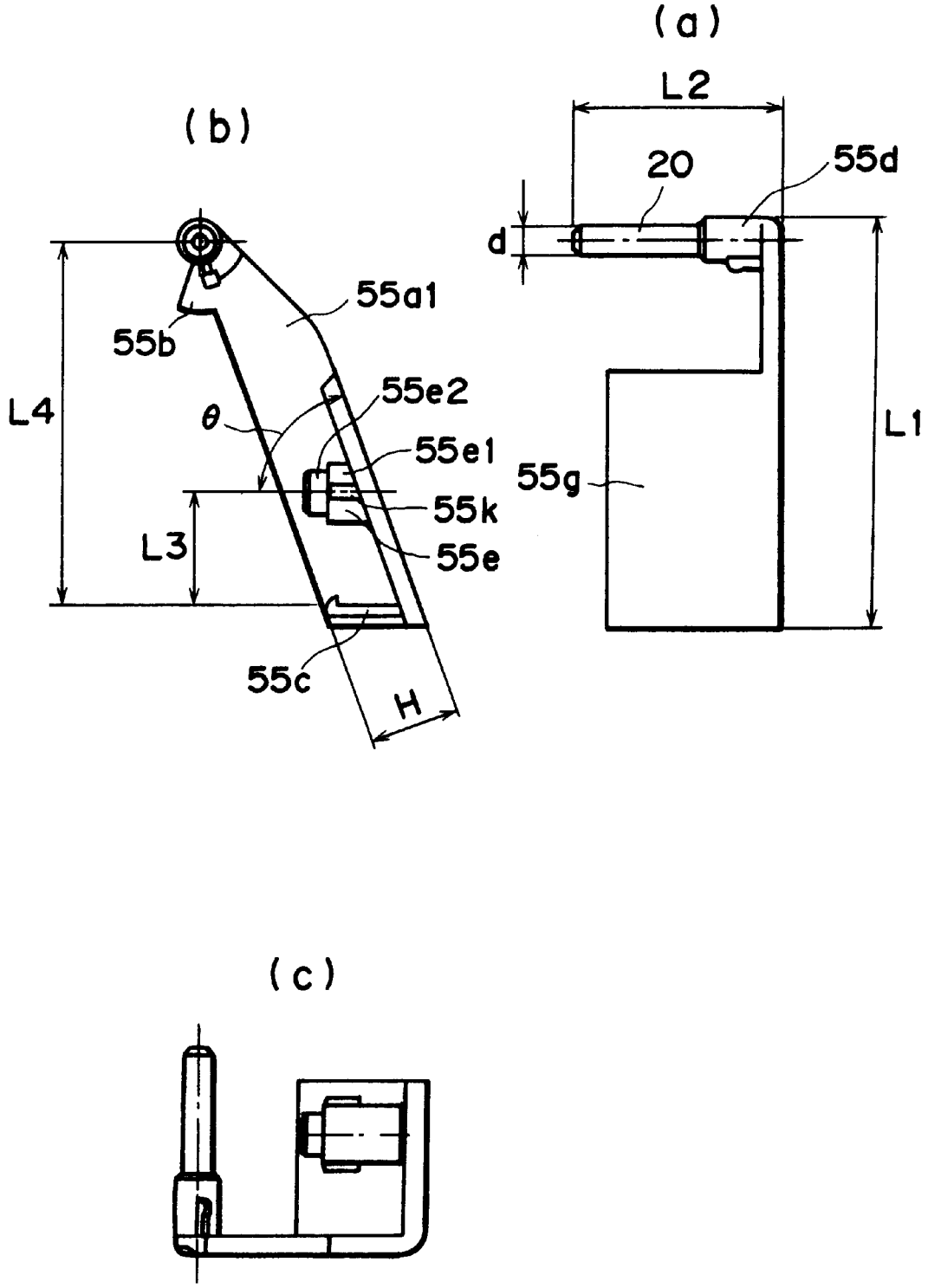
FIG. 18 shows a right-hand side coupling member.
Figure 19:
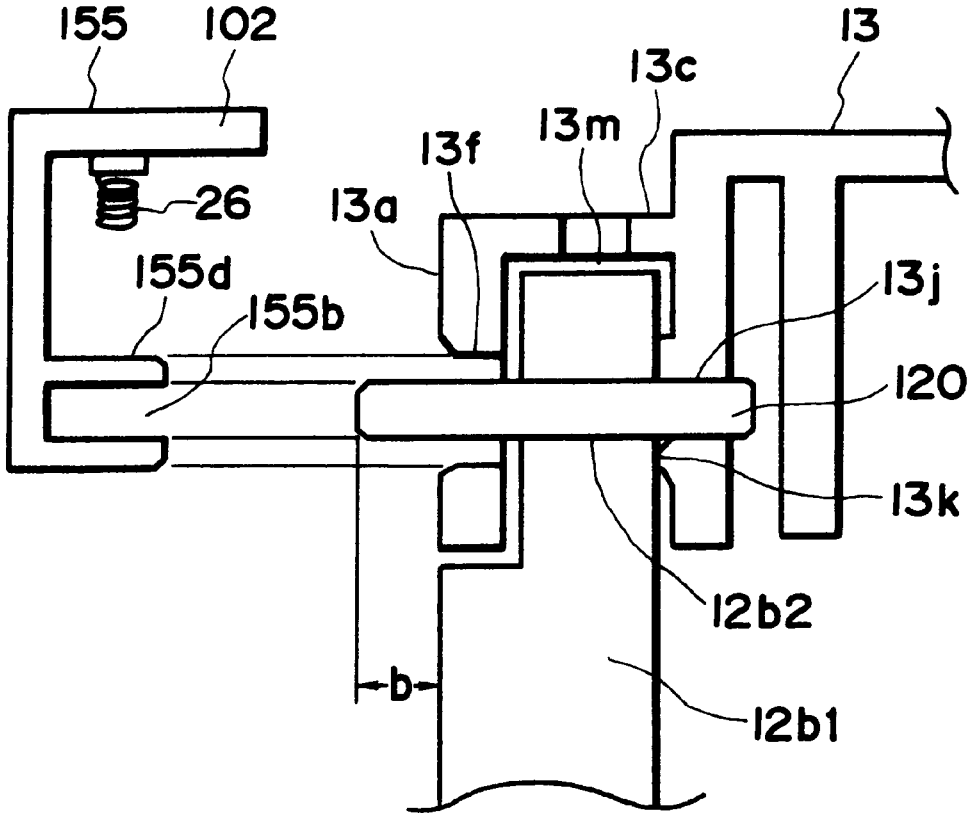
FIG. 19 is a longitudinal sectional view of a coupling member according to Embodiment 2.

FIG. 12 shows an example in which the coupling member 54 is mounted to the cleaning frame 13 using a snap fit mechanism. FIGS. 13–16 are perspective views of the coupling member of this example, and FIGS. 17, 18 are three side views thereof. At an end of the coupling member 54 which is opposite from the end having the shaft portion 20, an inverse claw 55*c* is provided extending from the end of the upper portion 55*g*, and the correspondingly, a non-circular hole 13*p* in which the inverse claw 55*c* is to be snap-fitted is formed in the recessed seat 13*c* of the cleaning frame 13.

The assembling method is the same as with the foregoing embodiment, except that at the last stage, the upper portion 55*g* is pushed toward the seat portion 13*c* by rotation about the shaft portion 20 and the second shaft portion 55*d*, so that leading edge of the inverse claw 55*c* flexes toward the shaft portion 20 by the edge defining the non-circular hole 13*p*. When the inverse claw 55*c* is completely received by the non-circular hole 13*p*, the inverse claw 55*c* spring-backs to be locked on the edge defining the non-circular hole 13*p*.

According to this embodiment, the assembling operation is easy and accurate, since the shaft member of the frame coupling member having the compression coil spring is inserted through the outer through-hole (opening) of the first frame, the hole (opening) of the second frame and the inner through-hole (opening) of the first frame, while the first frame and the second frame are abutted to each other; and the compression coil spring is compressed by rotation about the shaft portion, and the fixing member is threaded by a screw or is snap-fitted to the first frame.

In the foregoing embodiments and the embodiments which will be described hereinafter, the first frame is provided with a recess, and the second frame is provided with a projected portion (arm portion 12*b*1), and the projected portion is inserted into the recess, but the relation may be opposite. More particularly, the cleaning frame (first frame) may be provided with an arm portion as the projected portion, and the arm portion is inserted into a recess formed in the developing device frame (second frame), so that frames are coupled with each other by the above-described frame coupling member.

In the restraining portion of the coupling member is provided at a bottom portion, but it may be located otherwise. More particularly, a restraining member in the form of a dowel may be provided on the longitudinally inner bottom surface of the upper portion or the like, and the seat portion may be provided with a hole which receives the restraining member when the shaft portion is inserted into the openings of the frames and the frame coupling member rotates toward the first frame.

Other examples of the first shaft portion 20 and the second shaft portion 55*d* are:

(1) the fixing member 55, the first shaft portion 20 and the second shaft portion 55*d* are integrally formed.

(2) the first shaft portion 20 and the second shaft portion 55*d* are integrally formed, and the integral member is insert-molded with the fixing member.

(3) the shaft portion is in the form of one rod without the step, and the outer through-hole 13*f* has the same diameter as the hole 12*b*1 of the arm portion and as the inner hole 13*j*.

In this example, when the second shaft portion 55*d* has a diameter larger than that of the first shaft portion 20, the arm portion 12*b*1 of the developing device frame 12 is sandwiched by the end surface of the second shaft portion 55*d* and the abutment surface 13*k* of the boss projecting into the recess 13 of the cleaning frame 13. By doing so, the longitudinal positional relation between the cleaning frame 13 and the developing device frame 12, is assured in the longitudinal direction.

Embodiment 2

Figure 13:
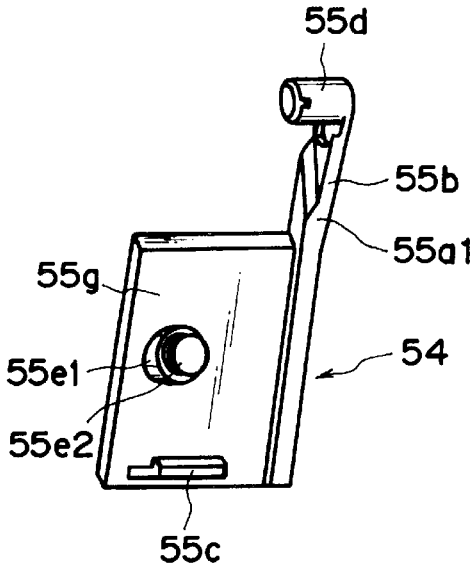
FIG. 13 is a perspective view of a left side coupling member according to a modified example of Embodiment 1.
Figure 14:
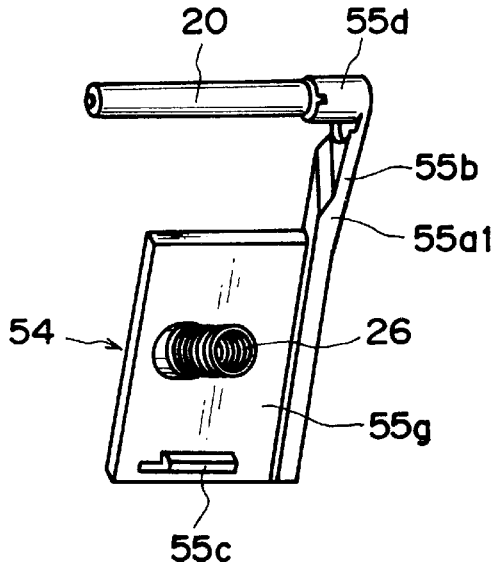
FIG. 14 is a perspective view of a left side coupling member according to a modified example of Embodiment 1.
Figure 15:
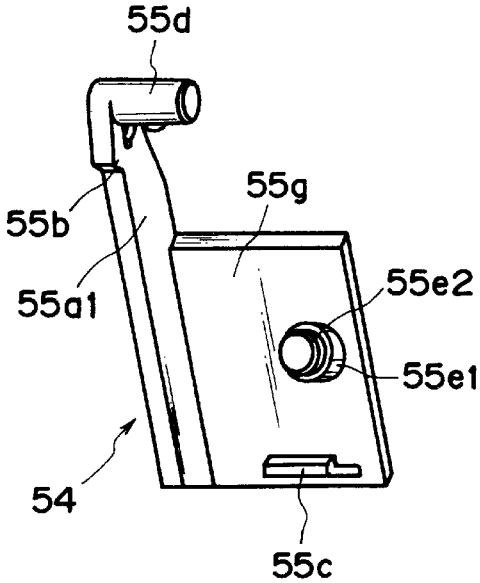
FIG. 15 is a perspective view of a right-hand side coupling member according to a modified example of the Embodiment 1.
Figure 16:
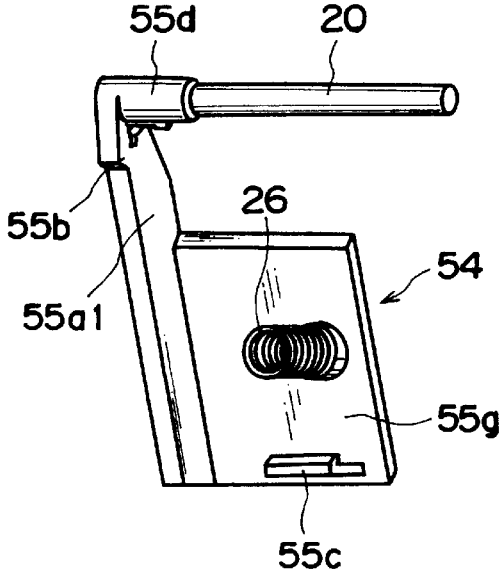
FIG. 16 is a perspective view of a right-hand side coupling member according to a modified example of the Embodiment 1.

Referring to FIG. 13, Embodiment 2 will be described. FIG. 13 is a schematic sectional view of the coupling member according to Embodiment 2 of the present invention. The same reference numerals as in the foregoing embodiment are assigned to the elements having the corresponding functions, and detailed descriptions thereof are omitted for simplicity. In Embodiment 1, the positioning shaft portion 20 is integral with the fixing member 55, but they may be separate members. In Embodiment 2, the first shaft portion can be inserted into the second shaft portion. More particularly, the second shaft portion 155*d* of the fixing member 155 is provided at the center with a hole portion

155*b* snugly fitted with the shaft member 120. The shaft member 120 is projected from the side surface 13*a* of the cleaning frame 13 in the assembled state, and the projection height thereof is b.

The arm portion 12*b*1 of the developing device frame 12 is inserted into the recess 13*m* of the cleaning frame 13, and thereafter, is inserted through the outer through-hole 13*f*, so that shaft member 120 is inserted through the hole 12*b*2 of the arm portion 12*b*1 and the inner through-hole 13*j* of the inner wall recess 13*m* of the cleaning frame 13, as shown in FIG. 13. Here, the hole portion 155*b* and the shaft member 120 are aligned with each other, while the compression coil spring 26 is places at a level higher than the seat portion 13*c* of the cleaning frame 13, and then, the fixing member 155 is moved horizontally toward the shaft member 120. Then, the hole portion 155*b* is first engaged with the shaft member 120. With further insertion of the fixing member 155, the second shaft portion 155*d* is inserted into the outer through-hole 13*f*, and the end surface of the second shaft portion 155*d* pushes the arm portion 12*b*1 so that arm portion 12*b*1 which is abutted to the surface 13*k* provided faced to the recess 13*m* of the cleaning frame 13.

The subsequent assembling operation is the same as with Embodiment 1.

The projection length b of the shaft member 120 from the side surface 13*a* of the cleaning frame 13 during the assembling operation, is larger than zero (b>0), and therefore, the hole portion 155*b* is engaged with the shaft member 120, and immediately thereafter, the second shaft portion 155*d* (outer diameter) is engaged with the external through-hole 13*f* of the cleaning frame 13. Therefore, the assembling operativity is maintained. Additionally, the same as Embodiment 1 applies with respect to the improvement in the productivity of the cleaning frame 13 and the retaining effect for the shaft member. The insertion molding is not necessary, since they are a separate member, and therefore, productivity is improved.

Specific Embodiment 1

A first specific embodiment is shown in FIGS. 10, 11. FIG. 10 shows a left side coupling member 54, and FIG. 11 shows a right-hand side coupling member 54. In FIG. 10, (a), the total length L1 of the left side coupling member 54 is 50 mm–65 mm, and preferably, approximately 57.8 mm. The total length L2 in the axial direction at the position of the shaft portion 20 is 25 mm–40 mm, and preferably, approximately 33.3 mm. The diameter d of the shaft portion 20 is 3 mm–5 mm, and preferably, approx 4 mm. In FIG. 10, (b), the height H is 5 mm–20 mm, and preferably, approximately 12.5 mm. The free length of the compression coil spring 26 is 15 mm–20 mm, and preferably, is approximately 17 mm, and the outer diameter thereof is 3 mm–5 mm, and preferably, approximately 4 mm. In FIG. 11, (a), the total length L1 of the right-hand side frame coupling member 54 is 50 mm–65 mm, and preferably approximately 56.5 mm. The total length L2 in the axial direction at the position of the shaft portion 20 is 25 mm–40 mm, and preferably, approximately 27.4 mm. The diameter d of the shaft portion 20 is 3 mm–5 mm, and preferably, approximately 4 mm. In FIG. 11, (b), the height H is approximately 24 mm. The spring specifications of the compression coil springs 26 at the left and right sides are the same. The distance L3 between the shaft portion 20 and the screw bore 55*f* is 39 mm–53 mm, and preferably, approximately 45 mm (both at the left and right sides).

The fixing member 55 which is the main body of the coupling member 54 made of synthetic resin material; the shaft portion 20 is made of stainless steel or plated steel material; and the compression coil spring 26 is made of a wire material of spring steel.

Specific Embodiment 2

A second specific embodiment is shown in FIGS. 17, 18. FIG. 17 shows a left side coupling member 54, and FIG. 18 shows a right-hand side coupling member 54. In FIG. 17, (a), the total length L1 of the left side coupling member 54 is 50 mm–65 mm, and preferably, approximately 57.8 mm. The total length L2 in the axial direction at the position of the shaft portion 20 is 25 mm–40 mm, and preferably, approximately 33.3 mm. The diameter d of the shaft portion 20 is 3 mm–5 mm, and preferably, approximately 4 mm. In FIG. 17, (b), the height H is 5 mm–20 mm, and preferably, approximately 12.5 mm.

The distance between the claw 55*c* and the urging portion 55*e* is 10 mm–20 mm, and preferably approximately 15.6 mm. The distance between the shaft 20 and the claw 55*c* is 45 mm–55 mm, and preferably, approximately 50.6 mm. The inclination angle θ of the urging portion 55*e* is 60°–80°, and preferably, approximately 70°.

The total length L1 of the right-hand side coupling member 54 is 50 mm–65 mm, and preferably, approximately 56.5 mm. The total length L2 in the axial direction at the position of the shaft portion 20 is 25 mm–40 mm, and preferably, approximately 27.4 mm. The diameter d of the shaft portion 20 is 3 mm–5 mm, and preferably, approximately 4 mm. In FIG. 17, (b), the height H is 5 mm–20 mm and preferably, approximately 12.5 mm.

The distance between the claw 55*c* and the urging portion 55*e* is 10 mm–20 mm, and preferably approximately 15.6 mm. The distance between the shaft 20 and the claw 55*c* is 45 mm–55 mm, and preferably, approximately 50.6 mm. The inclination angle θ of the urging portion 55*e* is 60°–80°, and preferably, approximately 70°.

The coupling member described in the foregoing is summarized as follows. The process cartridge is assembled using the coupling member.

A coupling member (e.g. 54) for coupling a first frame (e.g. Cleaning frame 13) for supporting an electrophotographic photosensitive member (e.g. Electrophotographic photosensitive drum 7) and a second frame (e.g. Developing device frame 12) for supporting a developing member (e.g. Developing roller 10*d*) for developing a latent image formed on the photosensitive member, the coupling member (54) comprising:

(a) a base (e.g. Fixing member 55);

(b) a shaft mounting portion (e.g. Second shaft portion 55*d*) provided in the base to mount a shaft (e.g. Shaft portion 20) for rotatably coupling said first frame and the second frame;

(c) an urging portion (e.g. Spring supporting portion 55*e*), provided in the base, for urging, to said second frame, a resilient member (e.g. Compression coil spring 26) for applying a resilient force between the first frame and the second frame;

(d) a fixed portion (inverse claw 55*c*, hole 55*f* for small screw), in the base, for fixing the base to the first frame.

The urging portion will suffice if it urges the elastic member to the second frame, and is not necessary to have an elastic member;

The urging portion has a first projected portion (e.g. Large diameter portion 55*e*1) projected from the base inclinedly toward the shaft mounting portion, and a second projected portion (e.g. small diameter portion 55*e*2) provided at a free end portion of the first projected portion, wherein the first projected portion and second projected portion are circular in outer shapes as seen in a projecting direction, and the second projected portion has an outer diameter which is smaller than an outer diameter of the first projected portion, and wherein the elastic member is mountable to a circular portion of the second projected portion;

The urging portion is not necessarily projected from the base, but is an elastic member bonded by a bonding agent to a flat portion of a concave of a base;

The first projected portion is provided with a rib (55*k*) for regulating a position of the first projected portion relative to the first frame when the base is fixed to the first frame. The rib is extended substantially parallel with a projecting direction of the first projected portion, and is projected from a circular outer surface of the first projected portion.

One end of a coil spring as the elastic member is mounted to the circular portion of the second projected portion.

The shaft mounting portion is projected from the base in a direction crossing with a longitudinal direction of the base, and is cylindrical in shape, and the shaft is mountable to an inner surface of the cylindrical.

One end of a metal rod as the shaft is mounted to an inner surface of the cylindrical portion.

The fixed portion is a screw bore (e.g. A hole 55*f* for a small screw), and the base is fixed to the first frame by fastening a screw to the first frame through the screw bore.

The fixed portion is a claw (e.g. inverse claw 55*c*), and the claw is resiliently engaged with the first frame so that base is fixed to the first frame.

The claw is projected from said base inclinedly toward the urging portion, and is substantially parallel with the projected portion of the urging portion, wherein an end of the claw is directed toward the urging portion, and to the projected portion a coil spring as the elastic member is mountable.

The shaft mounting portion, the urging portion and the fixed portion are provided in this order in a direction from one longitudinal end to the other longitudinal end of the base.

By doing so, the fixed portion is located more remote from the shaft than the urging portion. Therefore, the force imparted to the fixed portion is smaller than an elastic force of the elastic member imparted to the urging portion. Accordingly, the mechanical strength required for the fixed portion is smaller. The force for pressing the fixed portion against the elastic force of the elastic member when the base is fixed to the first frame, can be reduced. The base has a flat portion (e.g. Upper portion 55*g*) and an extension (55*a*1) extended from a lateral end of the flat portion in a longitudinal direction of the flat portion, and the urging portion and the fixed portion are provided to the flat portion, and the shaft mounting portion is provided on the extension.

The extension is provided with a position regulating portion (e.g. Retainer portion 55*b*) for regulating a position of the extension relative to the first frame by engagement with a groove of the first frame.

The developing roller (10*d*) as the developing member and the electrophotographic photosensitive drum (7) are urged toward each other by the elastic force of the resilient member through a spacer-roller.

The shaft is of metal, and the base, said shaft mounting portion, the urging portion and the fixed portion are of plastic resin material and are integrally formed.

When the coupling member is mounted to the first frame, a shaft mounted to the shaft mounting portion is engaged in a hole formed in the first frame, and by rotating the base toward the first frame about the shaft, the claw is engaged with the first frame, and the coupling member is fixed to the first frame by the shaft and the claw.

The process cartridge is assembled through the following assembling process.

An assembling method for a process cartridge detachably mountable to a main assembly of an electrophotographic image forming apparatus, comprising the steps of:

(a) a first step of supporting an electrophotographic photosensitive member on a first frame;

(b) a second step of supporting a developing member for developing a latent image formed on the photosensitive member, on a second frame;

(c) a third step of coupling the first frame and the second frame by a coupling member, which includes:

a base;

a shaft for rotatably coupling the first frame and the second frame relative to each other;

a shaft mounting portion, provided in the base, for mounting the shaft, wherein one end of the shaft is mounted to the shaft mounting portion;

an elastic member for applying a resilient force between the first frame and a second frame;

an urging portion, provided in the base, for urging the elastic member to the second frame, wherein the elastic member is mounted to the urging portion;

a fixed portion, provided in the base, for fixing the base to the first frame, wherein the base is fixed to the first frame at a fixed portion;

wherein the third step including:

engaging a shaft mounted to the shaft mounting portion into a hole formed in the first frame;

rotating the base toward the first frame about a shaft engaged in the hole;

the third step further including:

fixing the base to the first frame by threading a screw to the first frame through a screw bore as the fixed portion;

the third step further including:

fixing the base to the first frame by resilient engagement of a claw as the fixed portion with the first frame.

As described in the foregoing, according to the present invention, there are provided a coupling member, a process cartridge and a process cartridge wherein assembling operativity is improved.

Furthermore, there is provided an coupling member capable of easily coupling a first frame supporting an electrophotographic photosensitive member and a second frame for supporting a developing member for developing a latent image formed on the photosensitive member, a process cartridge, an assembling method of the process cartridge using such a coupling member.

While the invention has been described with reference to the structures disclosed herein, it is not confined to the details set forth and this application is intended to cover such modifications or changes as may come within the purposes of the improvements or the scope of the following claims.

What is claimed is:

1. A coupling member for coupling a first frame for supporting an electrophotographic photosensitive member and a second frame for supporting a developing member for developing a latent image formed on the photosensitive member, said coupling member comprising:

(a) a base, (b) a shaft mounting portion provided in said base to mount a shaft for rotatably coupling said first frame and said second frame, wherein said shaft provides a rotational center of rotation of said first and second frames relative to each other;

(c) an urging portion, provided in said base, for urging, to said second frame, a resilient member for applying a resilient force between said first frame and said second frame; and (d) a fixed portion, provided in said base, for fixing said base to said first frame.

2. A coupling member according to claim 1, wherein said urging portion has a first projected portion projected from said base inclinedly toward said shaft mounting portion, and a second projected portion provided at a free end portion of said first projected portion, wherein the outer shapes of said first projected portion and second projected portion are circular as seen in a projecting direction, and said second projected portion has an outer diameter which is smaller than an outer diameter of said first projected portion, and wherein said resilient member is an elastic member and is mountable to a circular portion of said second projected portion.

3. A coupling member according to claim 2, wherein said first projected portion is provided with a rib for regulating a position of said first projected portion relative to said first frame when said base is fixed to said first frame, and wherein the rib is extended substantially parallel with a projecting direction of said first projected portion, and is projected from a circular outer surface of said first projected portion.

4. A coupling member according to claim 3, wherein one end of a coil spring as said elastic member is mounted to the circular portion of said second projected portion.

5. A coupling member according to claim 1, wherein said fixed portion is a screw bore, and said base can be fixed to said first frame by threading a screw to said first frame through said screw bore.

6. A coupling member according to claim 1, wherein said fixed portion is a claw, and said claw is resiliently engageable with said first frame so that said base can be fixed to said first frame.

7. A coupling member according to claim 1, wherein said resilient member is a coil spring.

8. A coupling member according to claim 1, wherein said shaft mounting portion, said urging portion and said fixed portion are provided in this order in a direction from one longitudinal end to the other longitudinal end of said base.

9. A coupling member according to claim 1, wherein the developing member comprises a developing roller, wherein said developing roller and the electrophotographic photosensitive member can be urged toward each other by the resilient force of said resilient member through a spacer roller.

10. A coupling member according to claim 1, wherein said shaft is made of metal, and said base, said shaft mounting portion, said urging portion and said fixed portion are made of plastic resin material and are integrally formed.

11. A coupling member for coupling a first frame for supporting an electrophotographic photosensitive drum and a second frame for supporting a developing roller for developing a latent image formed on the photosensitive drum, said coupling member comprising:

(a) a base having a flat portion and an extension extending from a lateral edge of said flat portion in a longitudinal direction of said flat portion;

(b) a shaft mounting portion, provided in said extension, for mounting a shaft for rotatably coupling said first frame and said second frame, wherein said shaft mounting portion is projected from said extension in a direction crossing with a longitudinal direction of said extension, and is cylindrical in shape, and an end of said shaft is mountable to an inner surface of the cylindrical shaft mounting portion;

(c) an urging portion, provided in said flat portion, for urging, to said second frame, a coil spring for applying a resilient force between the first frame and the second frame, wherein said urging portion has a first projected portion projected from said base inclinedly toward said shaft mounting portion, and a second projected portion provided at a free end portion of said first projected portion, wherein the outer shapes of said first projected portion and second projected portion are circular as seen in a projecting direction, and said second projected portion has an outer diameter which is smaller than an outer diameter of said first projected portion, and wherein said coil spring is mountable to a circular portion of said second projected portion; and (d) a fixed portion, provided in said flat portion, for fixing said base to said first frame.

12. A coupling member according to claim 11, wherein said first projected portion is provided with a rib for regulating a position of said first projected portion relative to said first frame when said base is fixed to said first frame.

13. A coupling member according to claim 12, wherein one end of said coil spring is mounted to the circular portion of said second projected portion.

14. A coupling member according to claim 11, wherein one end of a metal rod as said shaft is mounted to an inner surface of the cylindrical shaft mounting portion.

15. A coupling member according to claim 11, wherein said fixed portion is a screw bore, and the flat portion is fixed to said first frame by threading a screw to said first frame through said screw bore.

16. A coupling member according to claim 11, wherein said fixed portion is a claw, and said claw is resiliently engaged with said first frame so that flat portion is fixed to said first frame.

17. A coupling member according to claim 16, wherein said claw is projected from said base inclinedly toward said urging portion, and is substantially parallel with the projected portion of said urging portion.

18. A coupling member according to claim 16, wherein when said coupling member is mounted to said first frame, a shaft mounted to said shaft mounting portion is engaged in a hole formed in said first frame, and by rotating said base toward said first frame about the shaft, said claw is engaged with said first frame, and said coupling member is fixed to said first frame by said shaft and said claw.

19. A coupling member according to claim 11, wherein said shaft mounting portion, said urging portion and said fixed portion are provided in this order in a direction from one longitudinal end to the other longitudinal end of said base.

20. A coupling member according to claim 11, wherein the extension is provided with a position regulating portion for regulating a position of said extension relative to said first frame by engagement with a groove of said first frame.

21. A coupling member according to claim 11, wherein the developing roller and the electrophotographic photosensitive drum are urged toward each other by the resilient force of said coil spring through a spacer-roller.

22. A coupling member according to claim 11, wherein said shaft is made of metal, and said flat portion and extension, said shaft mounting portion, said urging portion and said fixed portion are made of plastic resin material and are integrally formed.

23. A coupling member for coupling a first frame for supporting an electrophotographic photosensitive drum, a cleaning member for removing toner remaining on said electrophotographic photosensitive drum therefrom, a charging roller for charging said electrophotographic photosensitive drum, and a second frame for supporting a developing roller for developing a latent image formed on said electrophotographic photosensitive drum, said coupling member comprising:

(a) a base having a flat portion and an extension extending from a lateral edge of said flat portion in a longitudinal direction of said flat portion;

(b) a shaft for rotatably coupling said first frame and said second frame;

(c) a shaft mounting portion, provided in said extension, for mounting said shaft for rotatably coupling said first frame and said second frame, wherein said shaft mounting portion is projected from said extension in a direction crossing with a longitudinal direction of said extension, and is cylindrical in shape, and an end of said shaft is mounted to an inner surface of the cylindrical shaft mounting portion;

(d) a coil spring for applying resilient force between said first frame and said second frame;

(e) an urging portion, provided in said flat portion, for urging, to said second frame, said coil spring for applying a resilient force between the first frame and the second frame, wherein said urging portion has a first projected portion projected from said base inclinedly toward said shaft mounting portion, and a second projected portion provided at a free end portion of said first projected portion, wherein the outer shapes of said first projected portion and second projected portion are circular as seen in a projecting direction, and said second projected portion has an outer diameter which is smaller than an outer diameter of said first projected portion, and wherein said coil spring is mounted to a circular portion of said second projected portion; and (f) a claw for fixing said base to said first frame, wherein said claw is projected from said flat portion inclinedly toward said shaft mounting portion, and is substantially parallel with the shaft mounting portion, wherein an end of the claw is directed toward said urging portion, and said flat portion is fixed to said first frame by resilient engagement of said claw with said first frame.

24. A coupling member according to claim 23, wherein said first projected portion is provided with a rib for regulating a position of said first projected portion relative to said first frame when said base is fixed to said first frame.

25. A coupling member according to claim 23, wherein said shaft mounting portion, said urging portion and said claw are provided in this order in a direction from one longitudinal end to the other longitudinal end of said base.

26. A coupling member according to claim 23, wherein the extension is provided with a position regulating portion for regulating a position of said extension relative to said first frame by engagement with a groove of said first frame.

27. A coupling member according to claim 23, wherein the developing roller and the electrophotographic photosensitive drum are urged toward each other by the resilient force of said coil spring through a spacer-roller.

28. A coupling member according to claim 23, wherein when said coupling member is mounted to said first frame, said shaft mounted to said shaft mounting portion is engaged in a hole formed in said first frame, and by rotating said base toward said first frame about the shaft, said claw is engaged with said first frame, and said coupling member is fixed to said first frame by said shaft and said claw.

29. A process cartridge detachably mountable to a main assembly of an electrophotographic image forming apparatus, comprising:

(a) an electrophotographic photosensitive member;

(b) a developing member for developing a latent image formed on the photosensitive member;

(c) a first frame supporting said electrophotographic photosensitive member;

(d) a second frame supporting said developing member; and (e) a coupling member coupling said first frame and said second frame, said coupling member including:

1) a base;

2) a shaft which couples said first frame and said second frame for rotation relative to each other;

3) a shaft mounting portion, provided in said base, for mounting said shaft, wherein one end of said shaft is mounted to said shaft mounting portion;

4) a resilient member applying a resilient force between said first frame and a second frame;

5) an urging portion, provided in said base, for urging said resilient member to said second frame, wherein said resilient member is urged to said second frame by said urging portion; and 6) a fixed portion, provided in said base, for fixing said base to said first frame, wherein said base is fixed to said first frame at a fixed portion.

30. A process cartridge according to claim 29, wherein said urging portion has a first projected portion projected from said base inclinedly toward said shaft mounting portion, and a second projected portion provided at a free end portion of said first projected portion, wherein the outer shapes of said first projected portion and second projected portion are circular as seen in a projecting direction, and said second projected portion has an outer diameter which is smaller than an outer diameter of said first projected portion, and wherein said resilient member is mounted to a circular portion of said second projected portion.

31. A process cartridge according to claim 30, wherein said first projected portion is provided with a rib for regulating a position of said first projected portion relative to said first frame when said base is fixed to said first frame, and wherein the rib is extended substantially parallel with a projecting direction of said first projected portion, and is projected from a circular outer surface of said first projected portion.

32. A process cartridge according to claim 29, wherein said shaft mounting portion is projected from said base in a direction crossing with a longitudinal direction of said base, and is cylindrical in shape, and said shaft is mounted to an inner surface of the cylindrical shaft mounting portion.

33. A process cartridge according to claim 29, wherein said fixed portion is a screw bore, and said base is fixed to said first frame by threading a screw to said first frame through said screw bore.

34. A process cartridge according to claim 29, wherein said fixed portion is a claw, and said claw is resiliently engaged with said first frame so that base is fixed to said first frame.

35. A process cartridge according to claim 34, wherein when said coupling member is mounted to said first frame, said shaft mounted to said shaft mounting portion is engaged in a hole formed in said first frame, and by rotating said base toward said first frame about the shaft, said claw is engaged with said first frame, and said coupling member is fixed to said first frame by said shaft and said claw.

36. A process cartridge according to claim 29, wherein said claw is projected from said base inclinedly toward said urging portion, and is substantially parallel with a projected portion of said urging portion, wherein an end of the claw is directed toward said urging portion, and to said projected portion a coil spring as said resilient member is mountable.

37. A process cartridge according to claim 29, wherein said resilient member is a coil spring.

38. A process cartridge according to claim 29, wherein said shaft mounting portion, said urging portion and said fixed portion are provided in this order in a direction from one longitudinal end to the other longitudinal end of said base.

39. A process cartridge according to claim 29, wherein said base has a flat portion and an extension extending from a lateral end of said flat portion in a longitudinal direction of said flat portion, and said urging portion and said fixed portion are provided on said flat portion, and said shaft mounting portion is provided on said extension.

40. A process cartridge according to claim 39, wherein the extension is provided with a position regulating portion for regulating a position of said extension relative to said first frame by engagement with a groove of said first frame.

41. A process cartridge according to claim 29, wherein a developing roller as said developing member and the electrophotographic photosensitive member are urged toward each other by the resilient force of said resilient member through a spacer-roller.

42. A process cartridge according to claim 29, wherein said shaft is made of metal, and said base, said shaft mounting portion, said urging portion and said fixed portion are made of plastic resin material and are integrally formed.

43. A process cartridge detachably mountable to a main assembly of an electrophotographic image forming apparatus, comprising:

(a) an electrophotographic photosensitive drum;

(b) a developing roller for developing a latent image formed on said electrophotographic photosensitive drum;

(c) a first frame for supporting said electrophotographic photosensitive drum;

(d) a second frame for supporting said developing roller; and (e) a coupling member coupling said first frame and said second frame, said coupling member including:

1) a base having a flat portion and an extension extending from a lateral edge of said flat portion in a longitudinal direction of said flat portion;

2) a shaft which couples said first frame and said second frame for rotation relative to each other;

3) a shaft mounting portion, provided in said extension, for mounting said shaft for rotatably coupling said first frame and said second frame, wherein said shaft mounting portion is projected from said extension in a direction crossing with a longitudinal direction of said extension, and is cylindrical in shape, and an end of said shaft is mounted to an inner surface of the cylindrical shaft mounting portion;

4) a coil spring applying resilient force between said first frame and said second frame;

5) an urging portion, provided in said flat portion, for urging said coil spring to said second frame, wherein said urging portion has a first projected portion projected from said base inclinedly toward said shaft mounting portion, and a second projected portion provided at a free end portion of said first projected portion, wherein the outer shapes of said first projected portion and second projected portion are circular as seen in a projecting direction, and said second projected portion has an outer diameter which is smaller than an outer diameter of said first projected portion, and wherein said coil spring is mounted to a circular portion of said second projected portion; and 6) a fixed portion, provided in said flat portion, for fixing said base to said first frame, wherein said base is fixed to said first frame by said fixed portion.

44. A process cartridge according to claim 43, wherein said first projected portion is provided with a rib for regulating a position of said first projected portion relative to said first frame when said base is fixed to said first frame, and wherein the rib is extended substantially parallel with a projecting direction of said first projected portion, and is projected from a circular outer surface of said first projected portion.

45. A process cartridge according to claim 43, wherein said fixed portion is a screw bore, and said flat portion is fixed to said first frame by threading a screw to said first frame through said screw bore.

46. A process cartridge according to claim 43, wherein said fixed portion is a claw, and said claw is resiliently engaged with said first frame so that flat portion is fixed to said first frame.

47. A process cartridge according to claim 46, wherein said claw is projected from said base inclinedly toward said urging portion, and is substantially parallel with the first and second projected portions of said urging portion, wherein an end of the claw is directed toward said urging portion.

48. A process cartridge according to claim 46, wherein when said coupling member is mounted to said first frame, said shaft mounted to said shaft mounting portion is engaged in a hole formed in said first frame, and by rotating said base toward said first frame about the shaft, said claw is engaged with said first frame, and said coupling member is fixed to said first frame by said shaft and said claw.

49. A process cartridge according to claim 43, wherein said shaft mounting portion, said urging portion and said fixed portion are provided in this order in a direction from one longitudinal end to the other longitudinal end of said base.

50. A process cartridge according to claim 43, wherein the extension is provided with a position regulating portion for regulating a position of said extension relative to said first frame by engagement with a groove of said first frame.

51. A process cartridge according to claim 43, wherein the developing roller and the electrophotographic photosensitive drum are urged toward each other by the resilient force of said coil spring through a spacer-roller.

52. A process cartridge according to claim 43, wherein said shaft is made of metal, and said flat portion, said shaft mounting portion, said urging portion and said fixed portion are made of plastic resin material and are integrally formed.

53. A process cartridge detachably mountable to a main assembly of an electrophotographic image forming apparatus, comprising:

(a) an electrophotographic photosensitive drum;

(b) a developing roller for developing a latent image formed on the photosensitive member;

(c) a cleaning member for removing toner remaining on said electrophotographic photosensitive drum;

(d) a charging roller for charging said electrophotographic photosensitive drum:

(e) a first frame supporting said electrophotographic photosensitive drum, said cleaning member, and said charging roller;

(f) a second frame supporting said developing roller; and (g) a coupling member coupling said first frame and said second frame, said coupling member including:

1) a base having a flat portion and an extension extending from a lateral edge of said flat portion in a longitudinal direction of said flat portion;

2) a shaft which couples said first frame and said second frame for rotation relative to each other;

3) a shaft mounting portion, provided in said extension, for mounting said shaft for rotatably coupling said first frame and said second frame, wherein said shaft mounting portion is projected from said extension in a direction crossing with a longitudinal direction of said extension, and is cylindrical in shape, and an end of said shaft is mounted to an inner surface of the cylindrical shaft mounting portion;

4) a coil spring applying resilient force between said first frame and said second frame;

5) an urging portion, provided in said flat portion, for urging, to said second frame, said coil spring for applying a resilient force between the first frame and the second frame, wherein said urging portion has a first projected portion projected from said base inclinedly toward said shaft mounting portion, and a second projected portion provided at a free end portion of said first projected portion, wherein the outer shapes of said first projected portion and second projected portion are circular as seen in a projecting direction, and said second projected portion has an outer diameter which is smaller than an outer diameter of said first projected portion, and wherein said coil spring is mounted to a circular portion of said second projected portion; and 6) a claw for fixing said base to said first frame, wherein said claw is projected from said flat portion inclinedly toward said shaft mounting portion, and is substantially parallel with the first and second projected portions, wherein an end of the claw is directed toward said urging portion, and said flat portion is fixed to said first frame by resilient engagement of said claw with said first frame.

54. A process cartridge according to claim 53, wherein said first projected portion is provided with a rib for regulating a position of said first projected portion relative to said first frame when said base is fixed to said first frame, and wherein the rib is extended substantially parallel with a projecting direction of said first projected portion, and is projected from a circular outer surface of said first projected portion.

55. A process cartridge according to claim 53, wherein said shaft mounting portion, said urging portion and said fixed portion are provided in this order in a direction from one longitudinal end to the other longitudinal end of said base.

56. A process cartridge according to claim 53, wherein the extension is provided with a position regulating portion for regulating a position of said extension relative to said first frame by engagement with a groove of said first frame.

57. A process cartridge according to claim 53, wherein the developing roller and the electrophotographic photosensitive drum are urged toward each other by the resilient force of said coil spring through a spacer-roller.

58. A process cartridge according to claim 53, wherein said shaft is made of metal, and said flat portion, said shaft mounting portion, said urging portion and said claw are made of plastic resin material and are integrally formed.

59. A process cartridge according to claim 53, wherein when said coupling member is mounted to said first frame, said shaft mounted to said shaft mounting portion is engaged in a hole formed in said first frame, and by rotating said base toward said first frame about the shaft, said claw is engaged with said first frame, and said coupling member is fixed to said first frame by said shaft and said claw.

60. An assembling method for a process cartridge detachably mountable to a main assembly of an electrophotographic image forming apparatus, comprising the steps of:

(a) a first step of supporting an electrophotographic photosensitive member on a first frame:

(b) a second step of supporting a developing member for developing a latent image formed on the photosensitive member, on a second frame; and (c) a third step of coupling said first frame and said second frame by a coupling member, which includes:

a base;

a shaft for rotatably coupling said first frame and said second frame relative to each other;

a shaft mounting portion, provided in said base for mounting said shaft, wherein one end of said shaft is mounted to said shaft mounting portion;

a resilient member for applying a resilient force between said first frame and a second frame;

an urging portion, provided in said base, for urging said resilient member to said second frame, wherein said resilient member is mounted to said urging portion; and a fixed portion, provided in said base, for fixing said base to said first frame, wherein said base is fixed to said first frame at a fixed portion.

61. A method according to claim 60, wherein said third step includes the steps of:

engaging the shaft mounted to said shaft mounting portion into a hole formed in said first frame; and rotating said base toward said first frame about a shaft engaged in said hole.

62. A method according to claim 61, wherein said third step further includes the step of:

fixing said base to said first frame by threading a screw to said first frame through a screw bore as said fixed portion.

63. A method according to claim 61, wherein said third step further includes the step of:

fixing said base to said first frame by resilient engagement of a claw as said fixed portion with said first frame.

64. An assembling method for a process cartridge detachably mountable to a main assembly of an electrophotographic image forming apparatus, comprising the steps of:

(a) a first step of supporting an electrophotographic photosensitive drum on a first frame;

(b) a second step of supporting a developing roller for developing a latent image formed on said electrophotographic photosensitive drum, on a second frame; and (c) a third step of coupling said first frame and said second frame by a coupling member, which includes:

a base including a flat portion and an extension extending in a longitudinal direction of said flat portion from a lateral edge of said flat portion;

a shaft for rotatably coupling said first frame and said second frame relative to each other;

a shaft mounting portion, provided in said extension, for mounting said shaft for rotatably coupling said first frame and said second frame, wherein said shaft mounting portion is projected from said extension in a direction crossing with a longitudinal direction of said extension, and is cylindrical in shape, and an end of said shaft is mounted to an inner surface of the cylindrical shaft mounting portion;

a coil spring for applying resilient force between said first frame and said second frame:

an urging portion, provided in said flat portion, for urging said coil spring to said second frame, wherein said urging portion has a first projected portion projected from said base inclinedly toward said shaft mounting portion, and a second projected portion provided at a free end portion of said first projected portion, wherein said first projected portion and second projected portion are circular in outer shapes as seen in a projecting direction, and said second projected portion has an outer diameter which is smaller than an outer diameter of said first projected portion, and wherein said coil spring is mounted to a circular portion of said second projected portion; and a fixed portion, provided on said flat portion, for fixing said base to said first frame.

65. A method according to claim 64, wherein said third step includes the steps of:

engaging the shaft mounted to said shaft mounting portion into a hole formed in said first frame; and rotating said base toward said first frame about the shaft engaged in said hole.

66. A method according to claim 65, wherein said third step further includes the step of:

fixing said base to said first frame by threading a screw to said first frame through a screw bore as said fixed portion.

67. A method according to claim 65, wherein said third step further includes the step of:

fixing said base to said first frame by resilient engagement of a claw as said fixed portion with said first frame.

68. An assembling method for a process cartridge detachably mountable to a main assembly of an electrophotographic image forming apparatus, comprising the steps of:

(a) a first step for supporting, on a first frame, an electrophotographic photosensitive drum, a cleaning member for removing toner remaining on said electrophotographic photosensitive drum, and a charging roller for charging said electrophotographic photosensitive drum;

(b) a second step of supporting a developing roller for developing a latent image formed on said electrophotographic photosensitive drum, in a second frame; and (c) a third step of coupling said first frame and said second frame by a coupling member, which includes:

a base having a flat portion and an extension extending from a lateral edge of said flat portion in a longitudinal direction of said flat portion;

a shaft for rotatably coupling said first frame and said second frame;

a shaft mounting portion, provided in said extension, for mounting the shaft for rotatably coupling said first frame and said second frame, wherein said shaft mounting portion is projected from said extension in a direction crossing with a longitudinal direction of said extension, and is cylindrical in shape, and an end of said shaft is mounted to an inner surface of the cylindrical shaft mounting portion;

a coil spring for applying resilient force between said first frame and said second frame;

an urging portion, provided in said flat portion, for urging said coil spring to said second frame, wherein said urging portion has a first projected portion projected from said base inclinedly toward said shaft mounting portion, and a second projected portion provided at a free end portion of said first projected portion, wherein the outer shapes of said first projected portion and second projected portion are circular as seen in a projecting direction, and said second projected portion has an outer diameter which is smaller than an outer diameter of said first projected portion, and wherein said coil spring is mounted to a circular portion of said second projected portion; and a claw for fixing said base to said first frame, wherein said claw is projected from said flat portion inclinedly toward said shaft mounting portion, and is substantially parallel with the first and second projected portions, wherein an end of the claw is directed toward said urging portion, and said flat portion is fixed to said first frame by resilient engagement of said claw with said first frame.

69. A method according to claim 68, wherein said third step includes the steps of:

engaging a shaft engaged with the circular shaft mounting portion with a hole provided in said first frame;

rotating said base relative to said first frame about a shaft engaged with said hole; and resiliently engaging said claw with said first frame.

70. A coupling member for coupling a first frame and a second frame, comprising:

(a) a base;

(b) a supporting portion, provided in said base, for supporting a shaft for rotatably coupling said first frame and said second frame, wherein said shaft provides a rotational center of rotation of said first and second frames relative to each other;

(c) an urging portion for urging a resilient member; and (d) a fixed portion for fixing said base.

71. A coupling member for coupling a first frame for supporting an electrophotographic photosensitive member and a second frame for supporting a developing member for developing a latent image formed on the photosensitive member, said coupling member comprising:

(a) a base;

(b) a shaft provided in said base for rotatably coupling said first frame and said second frame;

(c) an urging portion, provided in said base, for urging, to said second frame, a resilient member for applying a resilient force between said first frame and said second frame; and (d) a fixed portion, provided in said base, for fixing said base to said first frame.

72. A coupling member according to claim 71, wherein said urging portion has a first projected portion projected from said base inclinedly toward said shaft, and a second projected portion provided at a free end portion of said first projected portion, wherein the outer shapes of said first projected portion and second projected portion are circular as seen in a projecting direction, and said second projected portion has an outer diameter which is smaller than an outer diameter of said first projected portion, and wherein said resilient member is mountable to a circular portion of said second projected portion.

73. A coupling member according to claim 72, wherein said first projected portion is provided with a rib for regulating a position of said first projected portion relative to said first frame when said base is fixed to said first frame, and wherein the rib is extended substantially parallel with a projecting direction of said first projected portion, and is projected from a circular outer surface of said first projected portion.

74. A coupling member according to claim 73, wherein one end of a coil spring as said resilient member is mounted to the circular portion of said second projected portion.

75. A coupling member according to claim 71, wherein said shaft is projected from said base in a direction crossing with a longitudinal direction of said base.

76. A coupling member according to claim 71, wherein said shaft is made of metal.

77. A coupling member according to claim 71, wherein said fixed portion is a screw bore, and said base can be fixed to said first frame by threading a screw to said first frame through said screw bore.

78. A coupling member according to claim 71, wherein said fixed portion is a claw, and said claw is resiliently engageable with said first frame so that base can be fixed to said first frame.

79. A coupling member according to claim 78, wherein said claw is projected from said base inclinedly toward said urging portion, and is substantially parallel with a projected portion of said urging portion, wherein an end of the claw is directed toward said urging portion, and to said projected portion a coil spring as said resilient member is mountable.

80. A coupling member according to claim 78, wherein when said coupling member is mounted to said first frame, said shaft is engaged in a hole formed in said first frame, and by rotating said base toward said first frame about the shaft, said claw is engaged with said first frame, and said coupling member is fixed to said first frame by said shaft and said claw.

81. A coupling member according to claim 71, wherein said resilient member is a coil spring.

82. A coupling member according to claim 71, wherein said shaft, said urging portion and said fixed portion are provided in this order in a direction from one longitudinal end to the other longitudinal end of said base.

83. A coupling member according to claim 71, wherein said base has a flat portion and an extension extending from a lateral end of said flat portion in a longitudinal direction of said flat portion, and said urging portion and said fixed portion are provided on said flat portion, and said shaft is provided on said extension.

84. A coupling member according to claim 83, wherein the extension is provided with a position regulating portion for regulating a position of said extension relative to said first frame by engagement with a groove of said first frame.

85. A coupling member according to claim 71, wherein the developing member comprises a developing roller, and wherein the developing roller and the electrophotographic photosensitive member can be urged toward each other by the resilient force of said resilient member through a spacer-roller.

86. A coupling member according to claim 71, wherein said shaft is made of metal, and said base, said urging portion and said fixed portion are made of plastic resin material, and said base, urging portion and said fixed portion are integrally formed.

87. A process cartridge detachably mountable to a main assembly of an electrophotographic image forming apparatus, comprising:

(a) an electrophotographic photosensitive member;

(b) a developing member for developing a latent image formed on the photosensitive member;

(c) a first frame supporting said electrophotographic photosensitive member;

(d) a second frame supporting said developing member; and (e) a coupling member coupling said first frame and said second frame, said coupling member including:

(1) a base;

(2) a shaft which is provided in said base and which couples said first frame and said second frame for rotation relative to each other;

(3) a resilient member applying a resilient force between said first frame and a second frame;

(4) an urging portion, provided in said base, for urging said resilient member to said second frame, wherein said resilient member is urged to said second frame by said urging portion; and (5) a fixed portion, provided in said base, for fixing said base to said first frame, wherein said base is fixed to said first frame at said fixed portion.

88. A process cartridge according to claim 87, wherein said urging portion has a first projected portion projected from said base inclinedly toward said shaft, and a second projected portion provided at a free end portion of said first projected portion, wherein the outer shapes of said first projected portion and second projected portion are circular as seen in a projecting direction, and said second projected portion has an outer diameter which is smaller than an outer diameter of said first projected portion, and wherein said resilient member is mounted to a circular portion of said second projected portion.

89. A process cartridge according to claim 88, wherein said first projected portion is provided with a rib for regulating a position of said first projected portion relative to said first frame when said base is fixed to said first frame, and wherein the rib is extended substantially parallel with a projecting direction of said first projected portion, and is projected from a circular outer surface of said first projected portion.

90. A process cartridge according to claim 87, wherein said shaft is projected from said base in a direction crossing with a longitudinal direction of said base.

91. A process cartridge according to claim 87, wherein said fixed portion is a screw bore, and said base is fixed to said first frame by threading a screw to said first frame through said screw bore.

92. A process cartridge according to claim 87, wherein said fixed portion is a claw, and said claw is resiliently engaged with said first frame so that base is fixed to said first frame.

93. A process cartridge according to claim 92, wherein when said coupling member is mounted to said first frame, said shaft is engaged in a hole formed in said first frame, and by rotating said base toward said first frame about the shaft, said claw is engaged with said first frame, and said coupling member is fixed to said first frame by said shaft and said claw.

94. A process cartridge according to claim 87, wherein said claw is projected from said base inclinedly toward said urging portion, and is substantially parallel with a projected portion of said urging portion, wherein an end of the claw is directed toward said urging portion, and to said projected portion a coil spring as said resilient member is mountable.

95. A process cartridge according to claim 87, wherein said resilient member is a coil spring.

96. A process cartridge according to claim 87, wherein said shaft, said urging portion and said fixed portion are provided in this order in a direction from one longitudinal end to the other longitudinal end of said base.

97. A process cartridge according to claim 87, wherein said base has a flat portion and an extension extending from a lateral end of said flat portion in a longitudinal direction of said flat portion, and said urging portion and said fixed portion are provided on said flat portion, and a shaft mounting portion is provided on said extension.

98. A process cartridge according to claim 97, wherein the extension is provided with a position regulating portion for regulating a position of said extension relative to said first frame by engagement with a groove of said first frame.

99. A process cartridge according to claim 87, wherein the developing member comprises a developing roller, and wherein the developing roller and the electrophotographic photosensitive member are urged toward each other by the resilient force of said resilient member through a spacer-roller.

100. A process cartridge according to claim 87, wherein said shaft is made of metal, and said base, said urging portion and said fixed portion are made of plastic resin material, and said base, urging portion and said fixed portion are integrally formed.

101. A process cartridge according to claim 29, 43, 53, or 87, wherein said shaft provides a rotational center of rotation of said first and second frames relative to each other.

102. A coupling member for coupling a first frame for supporting an electrophotographic photosensitive member and a second frame for supporting a developing member for developing a latent image formed on the photosensitive member, said coupling member comprising:

(a) a base;

(b) a shaft mounting portion provided in said base to mount a shaft for rotatably coupling said first frame and said second frame;

(c) an urging portion, provided in said base, for urging, to said second frame, a resilient member for applying a resilient force between said first frame and said second frame; and (d) a fixed portion, provided in said base, for fixing said base to said first frame, wherein said shaft mounting portion is projected from said base in a direction crossing with a longitudinal direction of said base, and is cylindrical in shape, and said shaft is mountable to an inner surface of the cylindrical shaft mounting portion.

103. A coupling member according to claim 102, wherein one end of a metal rod as said shaft is mounted to an inner surface of the cylindrical shaft mounting portion.

104. An assembling method according to claim 60, 64, 68, or 102, wherein said shaft provides a rotational center of rotation of said first and second frames relative to each other.

105. A coupling member for coupling a first frame for supporting an electrophotographic photosensitive member and a second frame for supporting a developing member for developing a latent image formed on the photosensitive member, said coupling member comprising:

(a) a base;

(b) a shaft mounting portion provided in said base to mount a shaft for rotatably coupling said first frame and said second frame;

(c) an urging portion, provided in said base, for urging, to said second frame, a resilient member for applying a resilient force between said first frame and said second frame; and (d) a fixed portion, provided in said base, for fixing said base to said first frame, wherein said fixed portion is a claw, and said claw is resiliently engageable with said first frame so that said base can be fixed to said first frame, wherein said claw is projected from said base inclinedly toward said urging portion, and is substantially parallel with a projected portion of said urging portion, and wherein an end of the claw is directed toward said urging portion, and to said projected portion a coil spring as said elastic member is mountable.

106. A coupling member for coupling a first frame for supporting an electrophotographic photosensitive member and a second frame for supporting a developing member for developing a latent image formed on the photosensitive member, said coupling member comprising:

(a) a base;

(b) a shaft mounting portion provided in said base to mount a shaft for rotatably coupling said first frame and said second frame;

(c) an urging portion, provided in said base, for urging, to said second frame, a resilient member for applying a resilient force between said first frame and said second frame; and (d) a fixed portion, provided in said base, for fixing said base to said first frame, wherein said fixed portion is a claw, and said claw is resiliently engageable with said first frame so that said base can be fixed to said first frame, wherein when said coupling member is mounted to said first frame, a shaft mounted to said shaft mounting portion is engaged in a hole formed in said first frame, and by rotating said base toward said first frame about the shaft, said claw is engaged with said first frame, and said coupling member is fixed to said first frame by said shaft and said claw.

107. A coupling member for coupling a first frame for supporting an electrophotographic photosensitive member and a second frame for supporting a developing member for developing a latent image formed on the photosensitive member, said coupling member comprising:

(a) a base;

(b) a shaft mounting portion provided in said base to mount a shaft for rotatably coupling said first frame and said second frame;

(c) an urging portion, provided in said base, for urging, to said second frame, a resilient member for applying a resilient force between said first frame and said second frame; and (d) a fixed portion, provided in said base, for fixing said base to said first frame, wherein said base has a flat portion and an extension extending from a lateral end of said flat portion in a longitudinal direction of said flat portion, and said urging portion and said fixed portion are provided on said flat portion, and said shaft mounting portion is provided on said extension.

108. A coupling member according to claim 107, wherein the extension is provided with a position regulating portion for regulating a position of said extension relative to said first frame by engagement with a groove of said first frame.

109. A coupling member for coupling a cleaning frame to a developing device frame of a process cartridge detachably mountable on and insertable into the main assembly of an image forming apparatus, said coupling member comprising:

a compression coil spring;

a shaft portion for rotatably coupling the developing device frame and the cleaning frame, wherein said shaft portion has a cylindrical shape, a fixing member to which said compression coil spring and said shaft portion are attached, said fixing member including:

a side portion in the form of a plate, said side portion being provided parallel with and adjacent to vertical side surfaces of each of the longitudinal ends of the cleaning frame when said coupling member couples said developing device frame and said cleaning frame, wherein said side portion comprises an extension portion comprising:

a circular second shaft portion; and a retainer portion, wherein said retainer portion is engageable with a retaining groove on the cleaning frame so that said fixing member is retained and correctly positioned in the longitudinal direction; and an upper portion extending from said side portion and being bent inwardly and having a substantially horizontal plate-like shape, wherein a section taken along a longitudinal and vertical plane of the upper portion and the side portion is substantially L-shaped, wherein said upper portion has a shape and dimensions to snugly fit on a recessed seat provided at an upstream corner as seen from an inserting direction of the process cartridge, at each of left and right ends of the upper surface of the cleaning frame, wherein the bottom surface of the recessed seat of the cleaning frame is in the form of a plate, wherein the depth of the recess and the thickness of the upper portion are substantially the same, wherein said upper portion comprises:

a spring-supporting projection comprising a spring supporting portion supporting said compression coil spring, wherein said spring-supporting projection is in the form of a stepped dowel comprising:

a large diameter portion configured to provide a seat for said compression coil spring, wherein said large diameter portion is provided with a rib for regulating a position of said large diameter portion relative to said developing device frame when said fixing member is fixed to said developing device frame, and wherein the rib extends substantially parallel with a projecting direction of said large diameter portion, and is projected from a circular outer surface of said large diameter portion; and a small diameter portion around which said compression coil spring is press-fitted, wherein the axis of said spring supporting portion is aligned with a center line of said compression coil spring press fitted around said small diameter portion, wherein the center line is substantially perpendicular to the upper surface of the arm portion of the developing device frame when the said compression coil spring is press-fitted around said small diameter portion after said process cartridge is assembled and said coupling member couples the cleaning frame and the developing device frame; and a claw engageable with one of said frames so that said fixing member can be fixed to said one of said frames, wherein said claw projects from said upper portion of said fixing member inclinedly toward said spring-supporting projection and is substantially parallel to said spring-supporting portion, wherein an end of said claw is directed toward said spring-supporting portion;

wherein said second shaft portion supports said shaft portion and supports one of opposite longitudinal ends of the developing device frame, wherein said shaft portion is positioned at the center of said second shaft portion;

wherein said shaft portion is configured and positioned to engage an outer through hole in a side portion of the cleaning frame and a hole in an arm portion of the developing device frame when said coupling member couples the developing device frame and the cleaning frame, and wherein the end surface of said second shaft portion is configured and positioned to abut an outer side surface of the arm portion when said shaft portion couples said fixing member, the developing device frame and the cleaning frame by engaging the outer through hole in the side portion of the cleaning frame and the hole in the arm portion.

110. A coupling member for coupling a cleaning frame to a developing device frame of a process cartridge detachably mountable on and insertable into a main assembly of an image forming apparatus, said coupling member comprising:

a compression coil spring;

a shaft portion for rotatably coupling the developing device frame and the cleaning frame, wherein said shaft portion has a cylindrical shape, a fixing member to which said compression coil spring and said shaft portion are mounted, said fixing member including:

a side portion in the form of a plate, the side portion being provided parallel with and adjacent to vertical side surfaces of each of the longitudinal ends of the cleaning frame when said coupling member couples said developing device frame and said cleaning frame, wherein said side portion comprises an extension portion comprising a circular second shaft portion; and an upper portion extending from said side portion and being bent inwardly and having a substantially horizontal plate-like shape, wherein a section taken along a longitudinal and vertical plane of the upper portion and the side portion is substantially L-shaped, wherein said upper portion has a shape and dimensions to snugly fit on a recessed seat provided at an upstream corner as seen from an inserting direction of the process cartridge, at each of left and right ends of the upper surface of the cleaning frame, wherein the bottom surface of the recessed seat of the frame is in the form of a plate, wherein the depth of the recess and the thickness of the upper portion are substantially the same, wherein said upper portion comprises:

a spring-supporting projection comprising a spring supporting portion supporting said compression coil spring, wherein said spring-supporting projection is in the form of a stepped dowel comprising:

a large diameter portion configured to provide a seat for said compression coil spring, wherein said large diameter portion is provided with a rib for regulating a position of said large diameter portion relative to said developing device frame when said fixing member is fixed to said developing device frame, and wherein the rib extends substantially parallel with a projecting direction of said large diameter portion, and is projected from a circular outer surface of said large diameter portion; and a small diameter portion around which said compression coil spring is press-fitted, wherein the axis of said spring supporting portion is aligned with a center line of said compression coil spring press fitted around said small diameter portion, wherein the center line is substantially perpendicular to the upper surface of the arm portion of the developing device frame when the said compression coil spring is press-fitted around said small diameter portion after said process cartridge is assembled and said coupling member couples the cleaning frame and the developing device frame; and a claw engageable with one of said frames so that said fixing member can be fixed to said one of said frames, wherein said claw projects from said upper portion of said fixing member inclinedly toward said spring-supporting projection and is substantially parallel to said spring-supporting portion, wherein an end of said claw is directed toward said spring-supporting portion, wherein said second shaft portion supports said shaft portion and supports one of opposite longitudinal ends of the developing device frame, wherein said shaft portion is positioned at the center of said second shaft portion;

wherein said shaft portion is configured and positioned to engage an outer through hole in a side portion of the cleaning frame and a hole in an arm portion of the developing device frame when said coupling member couples the developing device frame and the cleaning frame, and wherein the end surface of said second shaft portion is configured and positioned to abut an outer side surface of the arm portion when said shaft portion couples said fixing member, the developing device frame and the cleaning frame by engaging the outer through hole in the side portion of the cleaning frame and the hole in the arm portion.

111. A process cartridge detachably insertable in an inserting direction to a main assembly of an image forming apparatus, said cartridge comprising:

a cleaning frame supporting a photosensitive drum and a cleaning device positioned and configured to clean said photosensitive drum, said cleaning frame including vertical side surfaces, said cleaning frame further including a recessed seat provided at an upstream corner as seen from the inserting direction of the process cartridge, at each of left and right ends of the upper surface of the cleaning frame;

a developing device frame supporting a developing device, wherein said developing device frame comprises an arm portion projected toward the cleaning frame at each longitudinal end of said developing device frame when said cleaning frame and said developing device frame are coupled to one another; and two coupling members positioned and configured to couple said cleaning frame and said developing device frame, each of said coupling members comprising:

a compression coil spring;

a shaft portion for rotatably coupling said developing device frame and said cleaning frame, wherein said shaft portion has a cylindrical shape; and a fixing member supporting said compression coil spring and said shaft portion, wherein said fixing member comprises:

a side portion in the form of a plate extending substantially vertically when the coupling member is mounted, the side portion being provided parallel with and adjacent to vertical side surfaces of each of the longitudinal ends of the cleaning frame, wherein said side portion comprises:

an extension portion comprising:

a circular second shaft portion; and a retainer portion, wherein said retainer portion is engageable with a retaining groove in said cleaning frame so that said fixing member is retained and correctly positioned in the longitudinal direction;

an upper portion extending from said side portion and being bent inwardly and having a substantially horizontal plate-like shape, wherein a section taken along a longitudinal and vertical plane of the upper portion and the side portion is substantially L-shaped, wherein said upper portion has a shape and dimensions to snugly fit on the recessed seat provided at the upstream corner at each of left and right ends of the upper surface of the cleaning frame, wherein the bottom surface of the recessed seat of the frame is in the form of a plate, wherein the depth of the recess and the thickness of the upper portion are substantially the same, wherein said upper portion comprises:

a spring-supporting projection comprising a spring supporting portion supporting said compression coil spring, wherein said spring-supporting projection is in the form of a stepped dowel comprising:

a large diameter portion configured to provide a seat for said compression coil spring, wherein said large diameter portion is provided with a rib for regulating a position of said large diameter portion relative to said developing device frame when said fixing member is fixed to said developing device frame, and wherein the rib extends substantially parallel with a projecting direction of said large diameter portion, and is projected from a circular outer surface of said large diameter portion; and a small diameter portion around which said compression coil spring is press-fitted, wherein the axis of said spring supporting portion is aligned with a center line of said compression coil spring press fitted around said small diameter portion, wherein the center line is substantially perpendicular to the upper surface of the arm portion of the developing device frame when the said compression coil spring is press-fitted around said small diameter portion after said process cartridge is assembled by coupling said cleaning frame and said developing device frame with said coupling member;

a claw engageable with one of said frames so that said fixing member can be fixed to said one of said frames, wherein said claw projects from said upper portion of said fixing member inclinedly toward said spring-supporting projection and is substantially parallel to said spring-supporting portion, wherein an end of said claw is directed toward said spring-supporting portion, wherein the other of said fixing members comprises:

a side portion in the form of a plate extending substantially vertically when the coupling member is mounted, the side portion being provided parallel with and adjacent to vertical side surfaces of each of the longitudinal ends of the cleaning frame, wherein said side portion comprises an extension portion, wherein said extension comprises a circular second shaft portion; and an upper portion extending from said side portion and being bent inwardly and having a substantially horizontal plate-like shape, wherein a section taken along a longitudinal and vertical plane of the upper portion and the side portion is substantially L-shaped, wherein said upper portion has a shape and dimensions to snugly fit on the recessed seat provided at the upstream corner at each of left and right ends of the upper surface of the cleaning frame, wherein the bottom surface of the recessed seat of the frame is in the form of a plate, wherein the depth of the recess and the thickness of the upper portion are substantially the same, wherein said upper portion comprises:

a spring-supporting projection comprising a spring supporting portion supporting said compression coil spring, wherein said spring-supporting projection is in the form of a stepped dowel comprising:

a large diameter portion configured to provide a seat for said compression coil spring, wherein said large diameter portion is provided with a rib for regulating a position of said large diameter portion relative to said developing device frame when said fixing member is fixed to said developing device frame, and wherein the rib extends substantially parallel with a projecting direction of said large diameter portion, and is projected from a circular outer surface of said large diameter portion; and a small diameter portion around which said compression coil spring is press-fitted, wherein the axis of said spring supporting portion is aligned with a center line of said compression coil spring press fitted around said small diameter portion, wherein the center line is substantially perpendicular to the upper surface of the arm portion of the developing device frame when the said compression coil spring is press-fitted around said small diameter portion after said process cartridge is assembled by coupling said cleaning frame and said developing device frame with said coupling member;

a claw engageable with one of said frames so that said fixing member can be fixed to said one of said frames, wherein said claw projects from said upper portion of said fixing member inclinedly toward said spring-supporting projection and is substantially parallel to said spring-supporting portion, wherein an end of said claw is directed toward said spring-supporting portion, wherein each second shaft portion supports one of said shaft portions and supports one of opposite longitudinal ends of the developing device frame, wherein said shaft portion is positioned at the center of said second shaft portion, wherein each arm portion of said developing device frame has a hole therein for receiving one of said shaft portions, wherein said cleaning frame further comprises:

a recess at each longitudinal end of said cleaning frame, wherein each recess engages one of said arm portions projected toward the cleaning frame at one of opposite longitudinal ends of said developing device frame;

a side portion at each longitudinal end of said cleaning frame, each side portion being provided with an outer through hole engageable with one of said second shaft portions;

an upper surface comprising:

a recessed seat provided at an upstream corner of each of left and right ends of said upper surface as seen from the inserting direction of the process cartridge, wherein the bottom surface of said recessed seat includes a hole for receiving said compression coil spring;

a retaining groove provided at one longitudinal side of said upper surface for receiving said retainer portion; and two middle walls, each parallel to said side portions and each having an inner through hole therein for engaging one of said shaft portions when said shaft portions are inserted into said outer through hole of said side portion of said cleaning frame and said arm-portion hole of said developing device frame, and each having an inner wall for abutting one of said developing-device-portion arm portions when each of said arm portions is inserted into one of said recesses, wherein the end surface of each of said second shaft portions abuts an outer side surface of one of said arm portions when each of said shaft portions couples said fixing member, said developing device frame, and said cleaning frame by engaging said outer through hole in said side portion of said cleaning frame and said hole in said arm portion.

112. A coupling member according to claim 11, 23, 71, 105, 107, 109, 110, or 111, wherein said shaft provides a rotational center of rotation of said first and second frames relative to each other.

* * * * *

UNITED STATES PATENT AND TRADEMARK OFFICE

CERTIFICATE OF CORRECTION

PATENT NO. : 6,173,140 B1
DATED : January 9, 2001
INVENTOR(S) : Akira Suzuki, et al.

It is certified that error appears in the above-identified patent and that said Letters Patent is hereby corrected as shown below:

Column 1,
Line 28, "and" should read -- and a --.

Column 8,
Line 30, "contracts" should read -- contacts --.
Line 58, "forces to" should read -- faces --.

Column 11,
Line 13, "places" should read -- placed --.
Line 47, "approx" should read -- approximately --.
Line 67, "made" should read -- is made --.

Column 12,
Lines 52 and 56, "said" should read -- the --.

Column 13,
Lines 32 and 62, "said" should read -- the --.
Line 63, "are" should read -- are made --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*